US008270620B2

(12) United States Patent
Christensen

(10) Patent No.: US 8,270,620 B2
(45) Date of Patent: Sep. 18, 2012

(54) METHOD OF PERFORMING MEASUREMENTS BY MEANS OF AN AUDIO SYSTEM COMPRISING PASSIVE LOUDSPEAKERS

(75) Inventor: Knud Bank Christensen, Ryomgaard (DK)

(73) Assignee: The TC Group A/S (DK)

( * ) Notice: Subject to any disclaimer, the term of this patent is extended or adjusted under 35 U.S.C. 154(b) by 1108 days.

(21) Appl. No.: 12/097,708

(22) PCT Filed: Dec. 18, 2006

(86) PCT No.: PCT/DK2006/000723

§ 371 (c)(1),
(2), (4) Date: Jun. 16, 2008

(87) PCT Pub. No.: WO2007/068257

PCT Pub. Date: Jun. 21, 2007

(65) Prior Publication Data

US 2009/0003613 A1 Jan. 1, 2009

Related U.S. Application Data

(60) Provisional application No. 60/751,235, filed on Dec. 16, 2005.

(51) Int. Cl.
*H04R 29/00* (2006.01)

(52) U.S. Cl. ..... 381/56; 381/58; 381/59; 381/96; 381/300; 381/303

(58) Field of Classification Search ..... 381/56, 381/58, 59, 96, 300, 303
See application file for complete search history.

(56) References Cited

U.S. PATENT DOCUMENTS

| | | | | |
|---|---|---|---|---|
| 7,483,540 | B2 * | 1/2009 | Rabinowitz et al. | 381/103 |
| 7,526,093 | B2 * | 4/2009 | Devantier et al. | 381/59 |

FOREIGN PATENT DOCUMENTS

| | | |
|---|---|---|
| EP | 0617405 | 9/1994 |
| EP | 1349427 | 10/2003 |
| EP | 1443804 | 8/2004 |
| FR | 2413841 | 7/1979 |
| JP | 2001025085 | 1/2001 |
| JP | 2004193782 | 7/2004 |

OTHER PUBLICATIONS

International Search Report PCT/DK2006/000723 dated Feb. 22, 2007.

* cited by examiner

*Primary Examiner* — Minh-Loan T Tran
(74) *Attorney, Agent, or Firm* — Cantor Colburn LLP

(57) ABSTRACT

The present invention relates to a method of performing measurements by means of an audio system comprising passive loudspeakers, whereby said measurements loudspeakers for producing sound and at least one of said loudspeakers for measuring said sound. The present invention further relates to an audio system comprising N passive loudspeakers, wherein said audio system further comprises an output stage where each output acts as a combined output channel and a measurement input.

90 Claims, 7 Drawing Sheets

Fig. 4

Figure 1:
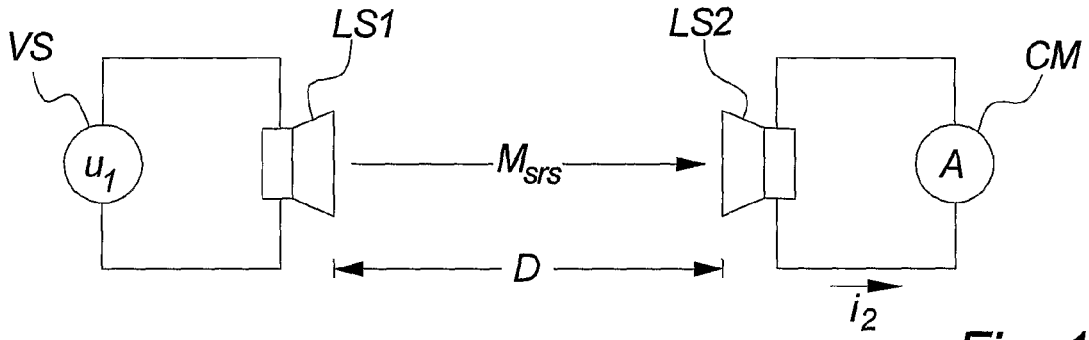

METHOD OF PERFORMING MEASUREMENTS BY MEANS OF AN AUDIO SYSTEM COMPRISING PASSIVE LOUDSPEAKERS

FIELD OF THE INVENTION

The present invention relates to obtaining information about acoustical and spatial properties of an audio system and its environment. The present invention further relates to dealing with unwanted degradation of sound quality in multichannel audio systems (e.g. home cinemas) caused by interaction between loudspeakers and room. A new method of identifying this with the purpose of subsequent equalization is presented.

BACKGROUND OF THE INVENTION

Countless excellent, expensive and beloved audio systems comprising conventional amplifiers and passive loudspeakers are installed all around in living rooms, listening rooms, home cinemas, conference rooms, concert halls, studios, etc., or are set up, packed, moved, set up, etc., by public address companies, band crews, etc. Such systems do typically not provide any means for obtaining information about the acoustical or spatial properties of the setup or surroundings. Other systems for obtaining such information have been provided, but require typically that separate measure microphones are set up, the speakers exchanged with self-calibrating active speakers or active or passive speakers comprising separate measure microphones installed, etc. Hence, no simple, automatic or semi-automatic means exists for the numerous owners of passive loudspeaker audio systems to obtain such information, if they want to keep using their existing loudspeakers and amplifiers.

The perceived sound quality of loudspeakers is affected by the listening room in several ways, typically referred to as boundary effect, room modes, discrete reflections and reverberation.

By boundary effect is referred to a particular type of interference that may occur for low frequency audio when a speaker is placed near walls or other reflective surfaces, as the direct sound from the loudspeaker is superposed with the sound reflected from the surfaces. The reflected, sounds appear to emanate from "mirror image sources" that are the physical speaker's geometrical mirror images in the surfaces. At very low frequencies, where the acoustical wavelength is many meters, e.g. 11.4 meters at 30 Hz, the direct sound and the reflections add up in constructive interference, because the differences in propagation distance from each source, mirror image source or real source, to listening position are much smaller than the wavelength. In this situation a 6 dB increase, i.e. a doubling of sound pressure, can be observed with every surface added, so a speaker placed in a corner, i.e. 3 boundaries, produces up to 18 dB more very-low-frequency sound pressure level at listening position than it would have in open air at the same distance. By sound pressure level is referred to $$SPL = 20\log_{10}\left(\frac{p_{\mathrm{RMS}}}{20\cdot 10^{-6}\,\mathrm{Pa}}\right)$$

where $p_{RMS}$ is the sound pressure in Pascal, and SPL is measured in decibels, dB. With decreasing wavelength, i.e. increasing frequency, the interference pattern becomes more complex with varying combinations of constructive and destructive interference between direct sound and reflections. This amounts to a significant deviation from a neutral, flat low-frequency response, and the deviation pattern is highly dependent on speaker placement with respect to the 3 nearest boundaries, e.g. floor, rear wall, side wall, and also dependent on surface absorption properties. This room-dependent low-mid-frequency coloration is called the boundary effect. Some consumer loudspeakers come with specific positioning recommendations and some even with built-in rudimentary equalization means for compensating the boundary effect, but in reality the boundary effect remains a great source of uncertainty in achieving a neutral reproduction of speech and music from quality loudspeakers. However the degrading influence of the boundary effect on sound reproduction can be greatly reduced by suitable equalization, that is: Filtering of the audio signal before it is sent to the speakers. A problem related to this is, however, how to determine the equalization parameters that may cause a reduction of the boundary effect without adding further or alternative degradation to the sound production.

Room modes refer to a different type of interference that occurs in closed rooms. In a closed room, the propagation path of higher-order reflections (reflections of reflections of reflections of . . . ) can form closed loops, the simplest case being the "ping-pong" propagation of a reflecting sound between two parallel walls. At frequencies where the propagation distance through one cycle of the loop is an integral number of wavelengths, all "generations" of the looped sound propagation are in phase, and a self-reinforcing, geometrically fixed pattern of sound is established in the room, with high sound pressure accumulating at certain places near the surfaces (particularly in corners where more surfaces meet) and high particle velocity (but low pressure) accumulating at other places in mid-air. For box-shaped rooms, this condition is fulfilled at frequencies $$f_{x,y,z} = \frac{c}{2}\sqrt{\left(\frac{n_x}{l_x}\right)^2 + \left(\frac{n_y}{l_y}\right)^2 + \left(\frac{n_z}{l_z}\right)^2}$$

where $l_{xyz}$ are room dimensions, $n_{xyz}$ are non-negative integers and c is the speed of sound. The particle velocity in and out of the room surfaces is of course minimal, actually zero for an ideal reflector. Such a pattern in called a room mode. In normal rooms, the SPL at pressure maxima can easily be 20 dB above average. This severe coloration is dependent on both listening position and speaker position. The mode acts as an imperfect energy accumulator and the speaker's ability to charge power into the "accumulator" depends strongly on its positioning within the geometrical modal pattern. Normal direct-radiating loudspeakers produce nearly constant volume-velocity, irrespective of the sound pressure on the speaker surface; hence, they inject maximal power into the mode when placed at pressure maxima, typically in a corner. Besides causing wild fluctuations in the steady-state frequency response that depend on both speaker and listening positions, the accumulating effect of the modes also provides the room with memory. The charging of the "accumulator" takes time, and when the source sound is cut off, the "accumulator" discharges through sound absorption. This memory effect is clearly demonstrable if for instance the door of a room is slammed and the decay of the sound observed, especially if the decaying sound is observed from a room corner. The room superposes the same tonal decay on the music played by loudspeakers. Thus, the room modes create highly frequency-dependent time smearing which also shows as peaks in the effective decay time of the room as a function of frequency. The decay time $T_{60}$ is the time it takes to decay 60 dB and is determined by the room volume $V_{room}$ and the combined equivalent absorption area of the room surfaces $S_i$ with their absorption coefficients $\alpha_i$:

$$T_{60}(f) = \frac{V_{room}}{\sum_{i=1}^{N_{materials}} S_i \alpha_i(f)} \cdot 0.161\,\mathrm{m}^{-1}\mathrm{s}$$

As mentioned, the room modes' effect on the (steady-state) frequency response of the audio reproduction system is highly position dependent. Therefore, equalization can only cure this problem at one or maybe a few selected listening positions. Added low-frequency absorption, in the form of passive absorbers or auxiliary subwoofers acting as active absorbers, appears to be the only overall cure for room modes. The time-smearing problem can be solved by modal equalization, but this requires a delicate identification of each separate room mode's frequency and damping. Modal equalization comprises cancelling the frequency domain poles of the room with zeros and placing new poles electronically at the same frequencies, but with damping factors corresponding to the room's overall low-frequency decay time. Such methods have been described further in the documents Makivirta, Karjalainen et al.: "Low-Frequency Modal Equalization Of Loudspeaker-Room Responses", AES Convention Paper 5480, hereby incorporated by reference, Karjalainen et al.: "Estimation of Modal Decay Parameters from Noisy Response Measurements", JAES Vol. 50 No. 11, November 2002, hereby incorporated by reference, Karjalainen et al.: "Frequency-Zooming ARMA Modeling of Resonant and Reverberant Systems", JAES Vol. 50 No. 12, December 2002, hereby incorporated by reference, and Rhonda J Wilson et al.: "The Loudspeaker-Room Interface—Controlling Excitation of Room Modes", Presented at 23rd International AES Conference, Copenhagen, Denmark, May 23-25, 2003, hereby incorporated by reference. A problem related to these methods is, however, how to determine the room modes, and thereby the poles to cancel.

Regarding discrete reflection at mid-to-high frequencies, reflections from room boundaries are more likely to be absorbed or diffused. If they are not, and this causes audible disturbance, there is very little to do about it in terms of signal processing. Adding passive absorption to the room becomes a much more feasible option at the shorter wavelengths. Carpets and curtains or even quite thin panels of absorbent material will generally do the job.

Border zone cases between boundary effect and discrete reflections are floor/ceiling reflections in domestic setups and console reflections in studio monitoring. Here the reflection arrives from the same azimuth angle as the direct sound, causing near-identical comb-filtering of the signals reaching both the listener's ears. Therefore, if this problem is not prevented from the outset by controlled vertical speaker directivity, equalization may still help. A problem related to this is, however, how to determine the equalization parameters that may cause such help.

The reverberant sound field is the semi-random (diffuse) mixture of all the higher-order reflections in the room. Unlike the modes, this does not add up in phase, hence the randomness. Ideally the diffuse sound field has no direction of propagation (i.e. no non-zero intensity vector) at any point. It is characterized by statistical means, namely the decay time. When the sound source is turned off, the diffuse sound field decays exponentially due to absorption in room surfaces and air.

As mentioned earlier, the decay time is a function of frequency f. If the decay time is too long in any part of the spectrum, degrading speech intelligibility and/or cluttering up the sound image in the recording, the only cures are adding absorption to the room or applying more directive loudspeakers, reducing the injection of sound power into the reverberant field. If the spectral color of the reverberation is too bright or too dull compared to what the loudspeaker manufacturer and record producer anticipated, a gentle, smoothly sloping; "tilt" equalizing filter may help, even though this will also affect the direct sound. If the reverberant sound field in the room is not sufficiently diffuse, diffusers (passive or active) can be added to the room. Finally, if the room is too "dry" (decay time too low), artificial reverberation can be added by running the audio signal through a suitable reverb algorithm and/or by installing an active room enhancement system, i.e. a complex network of reverb algorithms, amplifiers and loudspeakers, sometimes with microphones placed in the same room contributing to the network input. A problem related to improving the reverberation is how to automatically determine the way the current loudspeaker setup couples to the current room, in order to automatically suggest or perform a suitable equalization.

Existing automatic room correction systems on the market can be divided into systems with user-operated test microphones and systems with self-calibrating speakers.

The systems with user-operated test microphones are far the dominant class on the market. The reasoning is clear and logical: The sound that is heard must be measured before it can be improved. Usually this involves a measurement of the frequency response or the impulse response (may be obtained by two-channel analysis with any broad-band test signal) from each amplifier channel (voltage) to sound pressure at one or more target positions in the listening area. These measurements are then analyzed and transformed into an equalizer target response according to the chosen equalization philosophy (method). The equalization filter may then be automatically implemented in a DSP program. The test microphone is normally omni-directional (pressure sensitive), but some equalization philosophies may require other microphone types, such as cardioid or sound-field microphones. Within this very broad class of systems, any acoustical properties of room and loudspeakers can be measured and dealt with according to the preferred equalization philosophy. These systems and methods, however, require the user to obtain measurement equipment, perform time-consuming and cumbersome measurements according to advanced measuring schemes, and, for perfect results, do this anytime the listening position or room is changed, e.g. replacement or movement of furniture, speakers, listening position(s), etc. Furthermore, it may for some systems be a complex task to determine and implement equalization parameters suitable for reducing degradation of sound quality originating from the measured speaker-room coupling.

Of self-calibrating speaker systems the major system is Bang & Olufsen's Adaptive Bass Control (ABC), e.g.: available in the flagship product Beolab 5. The ABC technique is disclosed in European patents EP 0 772 374 and EP 1 133 896. The system employs a moving microphone for measuring the speaker's sound pressure responses and the sound pressure gradient responses very near the speaker itself. From this the acoustical radiation resistance presented to the speaker by the room and the speaker's acoustical power response (which is essentially proportional to the radiation resistance) in the actual position and environment are derived and transformed into an equalizer target response. This equalization philosophy, which is applied in the frequency range below 500 Hz, takes excellent care of the boundary effect problem. However, these intelligent speakers don't know anything about the listening position. So even though a speaker placement in a modal pressure maximum will be detectable, they are not able to know if the detected mode will result in a frequency response peak at listening position or not. A self-calibrating speaker system like the ABC does however require the user to replace his conventional speakers with the self-calibrating speakers, which are so far extremely expensive, and only available in very few configurations.

It is an object of the present invention to provide a method and system for performing acoustical measurements by means of an audio system comprising passive loudspeakers, and thereby facilitate owners of such systems to obtain acoustical and/or spatial information without exchanging their equipment.

It is a further object of the present invention to provide a method and system for automatically determining properties of the couplings between conventional, passive speakers and the listening room.

It is a further object of the present invention to provide a method and system for establishing and implementing equalization parameters suitable for correcting the determined couplings.

SUMMARY OF THE INVENTION

The present invention relates to a method of performing measurements by means of an audio system comprising passive loudspeakers, whereby said measurements are performed by using at least one of said loudspeakers for producing sound and at least one of said loudspeakers for measuring said sound.

According to the present invention, an advantageous method of establishing information by means of an audio system with passive loudspeakers is obtained. The invention facilitates making measurements using the passive loudspeakers of the system. The information established may, e.g., comprise information about distances between speakers, the location of walls and other acoustically significant objects, the acoustical properties of the room, e.g. room modes, etc. According to the present invention, even more information may be derived from the above, e.g. the layout of the speaker setup, the order of speakers in a speaker array, an acoustical image of the room, a mirror image source model of the room, room correcting equalization responses to correct acoustical deficiencies of the room, etc. In advanced embodiments, the invention may be used to facilitate optimal loudspeaker setup, automatic correction of acoustical deficiencies of the room, automatic calibration of the speaker setup, facilitate validation of large speaker setups, e.g. in public address PA systems, simulation of room response, e.g. to simulate different generic or specific rooms such as concert halls in general or a specific concert hall, etc.

Contrary to prior methods, no separate measure microphones or new, expensive, self-correcting loudspeakers are necessary. The present invention utilizes the duality of a passive loudspeaker, i.e. that it is capable of transducing both ways, namely, as its primary use, from electric power to sound, but also from sound to electric power as a microphone. Instead of measuring sound with an external microphone or exchanging the loudspeakers with expensive microphone-augmented loudspeaker systems, an embodiment of the present invention uses the existing, passive loudspeakers as both speakers and microphones for establishing a dynamic measurement setup that is capable of evaluating coloration responses of all the loudspeakers. The present invention thereby facilitates owners of, e.g., excellent and expensive passive loudspeaker systems to obtain information about the speakers, room or environment by means of exchanging or augmenting the amplifier instead of exchanging the speakers or adding dedicated measurement equipment. The obtained information may be provided to the user and/or analysed and refined by the system to provide useful high-level information or automatic calibration.

In short, it can be said that the present invention comprises exchanging a stupid amplifier with an intelligent one in an audio system with at least one passive loudspeaker, and thereby make it possible to obtain all kinds of information about the speakers and their environment.

According to the present invention, any reference to loudspeakers, speakers, speaker systems, loudspeaker systems, etc., is not limited to a single speaker unit, e.g. a single bass or tweeter unit, but may comprise several speaker units, e.g. a three-way speaker system comprising a bass unit, a mid-range unit and a tweeter unit and a corresponding passive crossover network. The reciprocity principle, i.e. the speaker-microphone duality, is equally true for passive speaker systems comprising several speaker units and passive crossover network as it is for single speaker units.

According to the present invention, passive loudspeakers may comprise any speaker that has the capability of acting as a microphone, i.e. any speaker or speaker system, with or without crossover networks, with any number of sound transducers that cause a signal to be established on its input terminals when exposed to sound pressure. Typically, all loudspeakers with passive crossover networks comply with this definition.

According to the present invention, an audio system may be any system that is capable of driving passive loudspeakers, and comprises thus typically an audio power amplifier.

According to the present invention, the sound may be any signal that may cause the relevant loudspeakers to produce a sound. The sound is according to a preferred embodiment white noise or a sine sweep, e.g. a logarithmic-frequency sine sweep, through the audio band, or a predetermined part thereof. In alternative embodiments the test sound comprises a maximum length sequence, typically referred to as MLS, or noise, e.g. pink noise. In further alternative embodiments, the test signal comprises music, speech or other relevant audio. In yet a further embodiment, no distinct test signal is provided; instead the measurements are performed on the audio currently being provided by the active audio source through the audio system.

When said measurements comprise acoustical measurements, an advantageous embodiment of the present invention is obtained.

According to the present invention, acoustical measurements comprise any kinds of measurements possible to make by transmitting sound from one or more loudspeakers, and measuring the result with the same or other passive loudspeakers. In a preferred embodiment, the a measurement controller has access to both the transmitted electrical signal that is transformed into sound, and the measured signal, that results from transforming sound into an electrical signal. Hence, the acoustical measurements may thus comprise, e.g., simple delay measurements, impulse responses, etc., using one or more loudspeakers for transmission and one or more loudspeakers, possibly even the same, for reception.

When said measurements comprises impulse responses $y_{srs}(t)$, an advantageous embodiment of the present invention is obtained.

According to an embodiment of the invention, the impulse response from a speaker to another speaker is measured. The impulse response in the time domain may be used to derive the delay between the speaker output and the speaker input, and thus the distance between the speakers by multiplying with the air-speed of sound, or it may be used, possibly in combination with impulse responses measured between other speaker pairs, to determine room responses or other acoustical properties of the speakers, the room, environment, etc.

When said measurements comprises speaker-room-speaker responses $M_{srs}$: AB, AC, . . . , EC, ED, an advantageous embodiment of the present invention is obtained.

According to an embodiment of the invention, the speaker-room-speaker response from a speaker to another speaker is measured. The speaker-room-speaker response in the frequency domain may be used to derive the delay between the speaker output and the speaker input, and thus the distance between the speakers by multiplying with the air-speed of sound, or it may be used, possibly in combination with responses measured between other speaker pairs, to determine room responses or other acoustical properties of the speakers, the room, environment, etc. Several analytical methods may preferably be performed on frequency domain representations of the measurements, as compared to time domain representations. It is noted, that transforming measurements between time and frequency domains, or any other representation that facilitates particular processing is within the scope of the present invention.

According to the present invention, a speaker-room-speaker response is preferably a representation of the outcome of exposing the test sound to a first speaker, acting as loudspeaker, then to the surroundings, e.g. the room, and then to a second speaker, acting as microphone. In other words, it represents the transfer function from the input terminals of a first speaker to the input terminals of a second speaker, where the input terminals of the second speaker act as output terminals. Such a response may be measured or determined in several ways.

When said audio system comprises N passive loudspeakers LS1, LS2; SA, SB, SC, SD, SE, and said measurements are performed between pairs of said loudspeakers, an advantageous embodiment of the present invention is obtained.

According to an embodiment of the present invention, measurements for each possible pair of speakers within the set of N passive loudspeakers are performed. It is noted that such pair measurements may in preferred embodiments be performed simultaneously, and thus not requiring the same number of test sound transmissions as the possible number of speaker pairs. Thereby the listener is disturbed with test sound as few times as possible, even though properties of all possible combinations of speakers are actually measured.

When said method comprises analysing said measurements for determining spatial information, an advantageous embodiment of the present invention is obtained.

According to a preferred embodiment of the present invention, the measurements are used for deriving spatial information, i.e. information about distances and positions within the room or environment of the audio system. This may, e.g., comprise distances to and/or locations of speakers, walls, etc.

When said spatial information comprises information about the distance between at least two of said speakers, an advantageous embodiment of the present invention is obtained.

According to an embodiment of the present invention, the distance between two speakers in the audio system may be determined. This information may be used for mere informational purposes, or it may be refined into higher level information by combining with other details.

When said spatial information comprises information about the relative location of said passive loudspeakers, an advantageous embodiment of the present invention is obtained.

According to a preferred embodiment of the present invention, the relative location of the speakers or some of the speakers may be derived from the measurements, e.g. by calculating the distances between all speaker pair combinations and from that information derive the speaker setup layout.

When said spatial information comprises information about acoustically substantially significant elements of the room, an advantageous embodiment of the present invention is obtained.

According to an embodiment of the present invention, the locations of walls, big furniture, broad door openings, etc., relative to the speakers, may be derived from the measurements. This information may be used for acoustical room correcting purposes, and/or it may be used to determine the locations of the speakers in the room, and even provide suggestions about optimal speaker locations.

When said spatial information comprises an acoustical image of the surroundings of said audio system, an advantageous embodiment of the present invention is obtained.

In an embodiment of the present invention, the room or environment, or at least acoustically significant elements thereof, may be determined. As described above, such information has several uses. The acoustical image may e.g. comprise a mirror image model of the speakers and the room. An acoustical image of the room may further be used to correct deficiencies of the room and/or to be able to simulate specific rooms or properties, and thereby, e.g., turn a living room into sounding like a particular concert hall, etc.

When said spatial information comprises information about an estimated listening position, an advantageous embodiment of the present invention is obtained.

In more advanced embodiments of the present invention, the system may refine the spatial information even further in order to, e.g., estimate the listener's position, e.g. assume it to be approximately in front of the centre speaker and, e.g., half between the centre speaker and the surround speakers, in a speaker layout that can be determined as resembling a typical 5-speaker surround sound setup, etc.

When said spatial information comprises an estimated optimal listening position, an advantageous embodiment of the present invention is obtained.

In an alternative embodiment, the system may provide a suggestion about the optimal listening position, based on the determined speaker setup, and preferably also taking into account any determined acoustical deficiencies of the room.

When said spatial information comprises an evaluation of the probability of the said loudspeakers being connected to the expected output channels, an advantageous embodiment of the present invention is obtained.

According to an embodiment of the present invention, the system may compare the determined speaker layout with the output channel types, e.g. centre channel, left surround, etc., and evaluate the probability of the setup being correct according to standard surround sound setups, etc. In an advanced embodiment, the system may allow a user to input information about the expected setup, and then validate that setup with the actual setup, and return information about any inconsistencies.

When said spatial information comprises information about the relative order of passive loudspeakers arranged in a loudspeaker array, an advantageous embodiment of the present invention is obtained.

According to an embodiment of the present invention, information about the relative distances determined by means of an embodiment of the present invention, may further be used for determining the relative order of the speakers in a loudspeaker array, e.g. in public address PA systems. An embodiment of the present invention further combines information about order and distances to provide or automatically set delays of the outputs in a PA system.

When said method comprises analysing said measurements for determining room response information, an advantageous embodiment of the present invention is obtained.

According to a preferred embodiment of the present invention, room response information is obtained. Such information may be used to analyse and correct acoustical deficiencies of the room, determine optimal speaker locations, determine the appearance or acoustical appearance of the room or environment, simulate other rooms or environments, etc.

When said method comprises analysing said measurements for determining mirror image sources, an advantageous embodiment of the present invention is obtained.

According to an embodiment of the invention, the measurements may be analysed to determine the mirror image sources corresponding to the speakers, i.e. virtual sources to the early reflections from walls and other acoustically significant objects.

When said method comprises analysing said measurements to determine a set of loudspeaker coloration responses A, B, C, D, E, an advantageous embodiment of the present invention is obtained.

According to the present invention, an advantageous method of determining how the loudspeakers of an audio system, e.g. in a living room, couples to the room, and what sound degradation is caused thereby.

By means of an embodiment of the present invention, it is possible to determine a coloration response for each loudspeaker comprised by an audio system, e.g. 5 loudspeakers of a surround sound system. The coloration may typically be caused by partly the loudspeaker itself, and partly the way it couples to the room or surroundings, e.g. causing boundary effects, room modes, discrete reflections, reverberant sound, etc.

When such colorations responses are determined, it is possible to counteract undesired coloration by performing equalization of the corresponding audio channels in the audio system, e.g. immediately prior to the power amplification. The necessary equalization may be determined automatically on the basis of the determined loudspeaker coloration responses and the desired target system response.

When said loudspeaker coloration responses A, B, C, D, E comprise representations of the frequency response of said loudspeakers LS1, LS2; SA, SB, SC, SD, SE and how said loudspeakers acoustically couple to their surroundings, an advantageous embodiment of the present invention is obtained.

According to the present invention, surroundings are to be understood broadly, i.e. any physically or virtually defined spatial room, e.g. a living room, conference room, outdoor environments, etc.

When said loudspeaker coloration responses A, B, C, D, E comprise least-squares average coloration log-magnitude responses of said loudspeakers LS1, LS2, SA, SB, SC, SD, SE, an advantageous embodiment of the present invention is obtained.

According to a preferred embodiment of the present invention, the loudspeaker coloration responses represent the average coloration responses as observed from the other speakers. As these are typically distributed around the room, whereas the listening position is typically somewhere inside this distribution area, the coloration responses averaged between observations from around the distribution area may fairly well represent the coloration response experienced from the listening position. Correlation between the average coloration responses and responses measured at the listening position can be shown experimentally.

When said using at least one of said loudspeakers for measuring said sound comprises utilizing said at least one loudspeaker as a microphone, an advantageous embodiment of the present invention is obtained.

According to the present invention, some or preferably all of the passive loudspeakers are used as microphones for performing the measurements, thereby providing a very beneficial and convenient way of enabling determination of the spatial information or coloration responses, as the typically required external microphones or specially-made microphone-augmented loudspeakers may thus be omitted, together with all the acts of arranging the test setup, etc.

When said measurements comprise measuring electrical properties between the terminals of said at least one of said loudspeakers used for producing said sound and the terminals of said at least one of said loudspeakers used for measuring said sound, an advantageous embodiment of the present invention is obtained.

According to the present invention electrical properties may e.g. comprise one or more of voltage, current, impedance, etc. The properties are in a preferred embodiment measured in the amplifier or a measurement augmentation to the amplifier according to an embodiment of the present invention, preferably at the output channels. In an alternative embodiment the measurements may be performed near the speakers instead. In a preferred embodiment, the output signal is not measured at the output terminals, but derived from within the amplifiers processing of the input signal.

When N is at least 2, preferably at least 3 and more preferably greater than 3, an advantageous embodiment of the present invention is obtained.

According to the present invention, only a distance and a common, average coloration response may be established with only two loudspeakers. With three or more loudspeakers the present invention facilitates establishing further or full spatial information and individual coloration responses for each speaker. As the coloration responses are average responses as observed from the other speakers, more speakers, e.g. five or seven, most often improve the results.

When said determining spatial information comprises measuring a response for each combinatorial pair of said loudspeakers, an advantageous embodiment of the present invention is obtained.

According to the present invention, determination of relative distances between the speakers can be made on the basis of only one delay measurement between each pair of speakers, regardless of order. A more reliable result may be obtained by measuring both ways for each pair.

When said measurements comprise measuring N−1 speaker-room-speaker responses for each of said loudspeakers, an advantageous embodiment of the present invention is obtained.

According to an embodiment of the present invention, N−1 measurements are performed for each speaker, i.e. one measurement per other speaker. Each pair of speakers is thus only measured in one direction, i.e. using the first speaker as only speaker and the second speaker as only microphone. For measuring all speaker pairs this way, N·(N−1)/2 measurements are needed.

When said measurements comprise measuring 2·(N−1) speaker-room-speaker responses for each of said loudspeakers, an advantageous embodiment of the present invention is obtained.

According to a preferred embodiment of the present invention, 2·(N−1) measurements are performed for each speaker, i.e. two measurements per other speaker. Each pair of speakers is thus measured in both directions, i.e. first using the first speaker as speaker and the second speaker as only microphone, and then vice versa. For measuring all speaker pairs this way, N·(N−1) measurements are needed. Compared to measuring only each pair in one direction, the additional measurements comprises in a preferred embodiment only one additional test sound sequence, as it is of no practical worth to perform less microphone measurements. In other words, the extra measurements are made just by letting all speakers except for the test sound speaker measure the sound in each test sound sequence.

When N is at least 3, and said measurements comprise measuring N·(N−1) speaker-room-speaker responses, where each of said N loudspeakers are used for producing sound in N−1 measurements, and each of said N loudspeakers are used for measuring said sound in N−1 measurements, an advantageous embodiment of the present invention is obtained.

According to a preferred embodiment of the present invention, all speakers are used for measuring test sound from all other speakers, thereby establishing the greatest possible number of measurements to base the average coloration response calculation or other analysis upon.

When said spatial information is determined by calculating cross correlation functions between said produced sound and said measured sound, an advantageous embodiment of the present invention is obtained.

According to a preferred embodiment of the present invention, it is possible to determine the spatial location of each loudspeaker comprised in an audio system e.g. 5 loudspeakers of a surround system relative to each other, by applying a cross correlation technique to transmitted test signals from one or more speakers acting as loudspeakers and received test signals form one or more speakers acting as microphones.

When such cross correlation technique is used it is possible to determine the distance between each loudspeaker in an audio system without having to solve heavy equation systems that require a lot of computational capacity and that are time consuming to solve.

Furthermore when such a cross correlation technique is used it is not necessary to determine and analyse a set of trans admittance pulse responses collected from an audio system related to the present invention in order to find the relative spatial location of each loudspeaker comprised in said audio system.

When distances between loudspeakers are determined on the basis of an analysis of cross correlation functions for absolute maxima and multiplying with the speed for sound through air, an advantageous embodiment of the present invention is obtained.

In a preferred embodiment of the present invention, the cross correlation calculations return the delays between the speakers, which may be converted into distances by multiplying with the speed of sound through air.

When said spatial information is determined by analysing impulse responses based on said measurements, an advantageous embodiment of the present invention is obtained.

In an embodiment of the present invention, the delays between the speakers are derived from the measured, impulse responses.

When said spatial information is determined by analysing speaker-room-speaker responses based on said measurements, an advantageous embodiment of the present invention is obtained.

In an embodiment of the present invention, the delays between the speakers are derived from the measured speaker-room-speaker responses.

When said loudspeaker coloration responses are determined by analysing an equation system based on said measurements, an advantageous embodiment of the present invention is obtained.

According to a preferred embodiment of the present invention, an average coloration response as observed from the other speakers may be determined by solving an equation system containing the responses for each speaker pair.

When said loudspeaker coloration responses are determined by solving an equation system comprising speaker-room-speaker responses, an advantageous embodiment of the present invention is obtained.

According to an embodiment of the present invention, the coloration responses for each speaker may be derived from the several speaker-room-speaker responses by solving an equation system comprising the speaker-room-speaker responses.

When a loudspeaker coloration response is determined for each of said N loudspeakers, an advantageous embodiment of the present invention is obtained.

When a loudspeaker coloration response is determined for each of said N loudspeakers by solving an equation system comprising N·(N−1) speaker-room-speaker responses, an advantageous embodiment of the present invention is obtained.

When said equation system is linear, an advantageous embodiment of the present invention is obtained.

When said speaker-room-speaker responses $M_{srs}$, AB, AC, . . . , EC, ED are log-magnitude responses, an advantageous embodiment of the present invention is obtained.

When said speaker-room-speaker responses $M_{srs}$, AB, AC, . . . , EC, ED are log-frequency responses or pairs of log-magnitude responses and group-delay responses, an advantageous embodiment of the present invention is obtained.

When said speaker-room-speaker responses $M_{srs}$, AB, AC, . . . , EC, ED are impulse responses, an advantageous embodiment of the present invention is obtained.

When an equalization target response for a loudspeaker is established on the basis of said loudspeaker coloration responses A, B, C, D, E, an advantageous embodiment of the present invention is obtained.

According to a preferred embodiment of the present invention, the determined loudspeaker coloration responses are used for establishing relevant equalization target responses that may be used to correct some or all of the undesired effects indicated by the coloration responses. The loudspeaker coloration responses may be said to be the outcome of ascertaining the existing sound degradation effects and other properties of the existing audio system, whereas the equalization target responses may be said to be the means for correcting desired aspects of the ascertained properties, e.g. sound degradation due to boundary effects, etc. Dynamic implementation of the equalization target responses in the audio system is thus what extends an embodiment of the present invention from being a mere measurement and analysing method into being an automatic room correction method.

When said equalization target response is established by subtracting a loudspeaker coloration response from a system target response, an advantageous embodiment of the present invention is obtained.

In a preferred embodiment of the present invention, the equalization target responses are determined as the difference between a desired response and the estimated, actual response, i.e. between the system target response and the loudspeaker coloration responses.

When said equalization target response is filtered, an advantageous embodiment of the present invention is obtained.

According to a preferred embodiment of the present invention, the established equalization responses are filtered before implementation, in order to apply further or less correction, or in order to protect the equipment or listener(s) from undesired consequences, such as clipping, damage to amplifiers or loudspeakers, annoying sound degradation, etc. The filtering may further comprise limiting the frequency range in which the correction is performed.

When said equalization target response is limited, an advantageous embodiment of the present invention is obtained.

According to a preferred embodiment of the present invention, a maximum possible signal boost, e.g. 12 dB, is set for avoiding clipping and/or damaging any equipment.

When an equalization target response is established for each of said N loudspeakers, an advantageous embodiment of the present invention is obtained.

According to a preferred embodiment of the present invention, correction for all measured loudspeakers, preferably all loudspeakers of the audio system, is performed.

When room modes of said surroundings are determined from said measurements, an advantageous embodiment of the present invention is obtained.

In an embodiment of the invention, room modes are determined during the analysis.

When room modes of said surroundings are determined from said speaker-room-speaker responses $M_{srs}$, AB, AC, . . . , EC, ED, an advantageous embodiment of the present invention is obtained.

When said equalization target response is established on the basis of said room modes, an advantageous embodiment of the present invention is obtained.

In an embodiment of the present invention, the effect of any room modes is corrected by means of the equalization target responses.

When said equalization target response is established on the basis of both a loudspeaker coloration response A, B, C, D, E and said room modes, an advantageous embodiment of the present invention is obtained.

When said equalization target response is implemented in an audio system comprising said N passive loudspeakers for enabling room corrected operation of said audio system in said surroundings, an advantageous embodiment of the present invention is obtained.

According to a very preferred embodiment of the present invention, loudspeaker coloration responses and/or room modes are determined and form basis for the establishment of relevant equalization target responses, which are implemented in an audio system, thereby enabling room corrected operation.

When said equalization target response is implemented in an audio system comprising said N passive loudspeakers for improving the tonal balance of said audio system in said surroundings, an advantageous embodiment of the present invention is obtained.

When said equalization target response is established and implemented in said audio system automatically, thereby providing automatic room correction, an advantageous embodiment of the present invention is obtained.

In a preferred embodiment, the establishment and implementation of equalization responses are performed automatically, irregardless of whether the process was initiated automatically or by user input. Thereby a full-automatic room correction system or a semi-automatic one-click room correction system is provided.

When said equalization target response is provided to a user as a recommendation, an advantageous embodiment of the present invention is obtained.

In an alternative embodiment of the present invention, the resulting equalization responses are provided to the user as recommendations instead of automatically being implemented. Thereby the method may be used in system with no possibility of automatic equalization, and/or when the user wants to review and possibly modify the recommended settings.

When said measurements and/or determining information is repeated several times and averaged information is determined, an advantageous embodiment of the present invention is obtained.

According to a preferred embodiment of the present invention, the measurements are repeated several times, and the averages used for determining spatial information or coloration responses, etc. In an alternative embodiment the measurements and calculations are performed in full several times, and the results averaged for providing average information.

When said determining a set of loudspeaker coloration responses is repeated several times and a set of average loudspeaker coloration responses is determined, an advantageous embodiment of the present invention is obtained.

In an embodiment of the present invention, the measurement and analysing process is performed several times and the results averaged in order to filter out noise, e.g. from background noise, measurement noise, etc.

When said measurements are performed several times, average measurement results calculated, and said determining information is based thereon, thereby determining averaged information, an advantageous embodiment of the present invention is obtained.

In a preferred embodiment of the present invention, noise, e.g. from background noise or measurement noise, etc., is filtered out by averaging during the process of measuring. It is thereby also possible for the measurement process to automatically determine the amount of inaccuracy caused by noise or other deviation, and thereby determine the required number of measurements necessary to obtain a desired accuracy. The information determined may, e.g., be a set of average loudspeaker coloration responses.

When said sound comprises white noise, an advantageous embodiment of the present invention is obtained.

According to a preferred embodiment of the present invention, white noise is used as sound for the measurements. If several loudspeakers produce sound simultaneously, they should be driven by sound signals from different sources, e.g.

different white noise sources, to enable the measurement controller to distinguish the different loudspeakers in the measured signals. The best distinction between different loudspeakers, with the highest level above the noise floor is obtained by using white noise sources.

When said sound comprises a sine sweep, an advantageous embodiment of the present invention is obtained.

In an embodiment of the present invention, the test sound is a sine sweep, e.g. a logarithmic-frequency sine sweep, but a sweep within the scope of the invention may comprise any development through a predefined frequency range.

When said sound comprises music, an advantageous embodiment of the present invention is obtained.

According to an embodiment of the present invention, the sound used for the measurements is music, speech or any other audio signal that is otherwise processed by the audio system. This enables the system to perform measurements and analysis while the system is used for playing music, etc. Hence a run-time analysis may be performed for properties that changes or may change during play, e.g. in a public address PA system. Alternatively, the test sound used by the system may be music in order to disturb the listener as little as possible.

When said sound comprises maximum length sequence MLS signals, an advantageous embodiment of the present invention is obtained.

When said sound comprises pink noise, an advantageous embodiment of the present invention is obtained.

When one loudspeaker produces sound and at least two loudspeakers measures said sound simultaneously, an advantageous embodiment of the present invention is obtained.

According to an embodiment of the invention, the number of necessary sound bursts is minimized by measuring the sound from one loudspeaker by more speakers simultaneously.

When at least two loudspeakers produce different sound and at least one loudspeaker measures said sound, an advantageous embodiment of the present invention is obtained.

According to an embodiment of the invention, the number of necessary sound bursts is minimized by using more speakers for producing sound simultaneously. In a preferred embodiment the sound produced by each speaker is derived from different sources, preferably different white noise sources, in order to facilitate distinction between the different loudspeakers within the measured signals, which comprises an acoustically mixed version of all sound sources.

When said loudspeakers produce and measure sound simultaneously, an advantageous embodiment of the present invention is obtained.

According to an embodiment of the present invention, the number of necessary sound bursts is minimized by using the speakers as speakers and microphones simultaneously. This requires a measurement controller that is able to perform measurements on active output channels, e.g. a controller according to the present invention. In this embodiment the loudspeakers even measures their own output, which may be used for establishing even further information, e.g. about the efficiency of the speakers, i.e. the amount of power delivered to the room, as this partly depends on the locations, nearby objects such as walls, etc.

When said measurements are performed within a frequency range of 1 Hz to 20 kHz, an advantageous embodiment of the present invention is obtained.

According to an embodiment of the present invention, the analysis, e.g. room correction, is performed for the full audio frequency range.

When said speaker-room-speaker responses are measured for a frequency range of 5 Hz to 500 Hz, an advantageous embodiment of the present invention is obtained.

According to a preferred embodiment of the present invention, only a low-frequency range within the audio range is made the object of room correction, as sound degradation effects of higher frequencies are, nevertheless, often impossible to correct by means of equalization, and loudspeaker directivity will become a major disturbing factor in the process.

When said equalization target responses comprise equalization parameters for the frequency range of 5 Hz to 500 Hz, an advantageous embodiment of the present invention is obtained.

When said determining a set of loudspeaker coloration responses and establishing equalization target responses is initiated by a user, an advantageous embodiment of the present invention is obtained.

In a preferred embodiment of the present invention, the user may initiate the automatic room correction or measurement process when desired, e.g. after rearranging the living room, or just once in a while to maintain the correction.

When said determining a set of loudspeaker coloration responses and establishing equalization target responses is performed automatically, an advantageous embodiment of the present invention is obtained.

According to a preferred embodiment of the invention, the room correction may be automatically performed, thereby maintaining a suitable room correction without requiring the user to perform a certain task regularly.

When a set of equalization target responses for improving the tonal balance of an audio system in a room, said audio system comprising at least N passive loudspeakers, N being at least two, is established by performing the steps of:

determining, for P combinations of loudspeaker pairs in said audio system, the speaker-room-speaker response for a test signal provided to a loudspeaker of said loudspeaker pair and captured by the other loudspeaker of said loudspeaker pair, said other loudspeaker operating as a microphone, P being equal to or larger than N, establishing N equalization target responses on the basis of said P speaker-room-speaker responses, said N equalization target responses corresponding to said N loudspeaker channels of said audio system, an advantageous embodiment of the present invention is obtained.

The present invention further relates to a method of determining relative locations of at least two passive loudspeakers, comprising the steps of producing sound by said loudspeakers and measuring said sound by said loudspeakers, calculating cross-correlation functions of pairs of produced sound and measured sound, analysing said cross-correlation functions to determine relative distances between pairs of said loudspeakers, and analysing said relative distances to determine said relative locations.

According to the present invention, an advantageous method of determining the spatial layout of the actual speaker setup is provided. Relative locations may comprise three-dimensional vectors between the speakers in the setup, preferably a vector from each speaker to each of the other speakers. Thereby a full layout may be determined, however not fixed to any external fix point, such as walls, a corner, etc. Information about walls, etc., and thereby fixation of the layout relative to the environment may be obtained by other embodiments of the present invention, further comprising analysis of room responses, etc.

When said sound comprises white noise, an advantageous embodiment of the present invention is obtained.

According to a preferred embodiment of the present invention, white noise is used for the measurements, as it ideally is the sound that is easiest to separate from noise floor, background noise, etc. Moreover it provides the easiest distinction between the loudspeakers in a mixed signal, as long as different white noise sources are used.

When said relative locations are presented by output means, an advantageous embodiment of the present invention is obtained.

According to a preferred embodiment of the invention, output means are provided for presenting the results to the user, for communication the results to other processing means, or for providing suggestions or other information derived from the results.

When said method further comprises a method for performing measurements according to any of the above, an advantageous embodiment of the present invention is obtained.

The present invention further relates to a method of determining a set of loudspeaker coloration responses A, B, C, D, E for at least one out of N passive loudspeakers LS1, LS2, SA, SB, SC, SD, SE, whereby said loudspeaker coloration responses are determined by analysing measurements performed by using at least one of said loudspeakers for producing test sound and at least one of said loudspeakers for measuring said test sound.

According to the present invention, an advantageous method of determining how the speakers of an audio system with passive loudspeakers couples to the room, and the acoustics of the room are is provided. According to a preferred embodiment, the determined coloration responses are used for establishing equalization target responses to counteract the acoustical deficiencies of the room.

When said loudspeaker coloration responses A, B, C, D, E comprise representations of the frequency response of said loudspeakers LS1, LS2, SA, SB, SC, SD, SE and how said loudspeakers acoustically couple to their surroundings, an advantageous embodiment of the present invention is obtained.

When an equalization target response for a loudspeaker is established on the basis of said loudspeaker coloration responses A, B, C, D, E, an advantageous embodiment of the present invention is obtained.

When said method further comprises a method for performing measurements according to any of the above, an advantageous embodiment of the present invention is obtained.

The present invention further relates to an audio system comprising N passive loudspeakers LS1, LS2; SA, SB, SC, SD, SE, wherein said audio system further comprises an output stage RCA; RCM where each output acts as a combined output channel and a measurement input.

According to a preferred embodiment of the present invention, an output stage comprising loudspeaker outputs which may also be used as microphone inputs is provided, thereby enabling the existing, passive speakers to be used as microphones when measuring delays, speaker-room-speaker responses, etc., without rearranging any cables or jacks. Thereby is enabled convenient establishment of information, spatial information, room correction, etc., either full-automatic, or with very modest requirements to the user participation, e.g. a one-click control. As the measurement output stage according to the present invention may be used, and should be used according to a preferred embodiment of the present invention, for the daily use of the audio system, the present embodiment enables regularly performed evaluation of information or room correction maintenance with no additional equipment or preparation. Thereby a very reasonable alternative to obtaining expensive, self-correcting, active speakers or managing and setting up advanced measurement equipment is provided. The existing, passive speaker setup and any audio sources and preamplifiers may typically be kept and used with the room correcting or measurement output stage, and hence typically only the power stage has to be exchanged with a room correcting or measurement output stage or augmented with the measurement and equalization part of one, according to the present invention.

When said audio system comprises means for performing measurements by using at least one of said loudspeakers as a microphone, an advantageous embodiment of the present invention is obtained.

According to the present invention, the fact that passive loudspeakers may be used both for transforming electrical signals into sound, or transforming sound into electrical signals, i.e. act as microphones, is utilized for facilitating an audio system comprising passive speakers to perform acoustical measurements by using some or all of the loudspeakers as microphones.

When said measurements comprise impulse responses $y_{srs}(t)$, an advantageous embodiment of the present invention is obtained When said measurements comprise speaker-room-speaker responses $M_{srs}$, AB, AC, . . . , EC, ED, an advantageous embodiment of the present invention is obtained.

When said output stage RCA; RCM comprises a measurement controller RCC, an advantageous embodiment of the present invention is obtained.

According to a preferred embodiment of the present invention, a measurement controller is provided as part of the output stage. The measurement controller controls the measurements by providing sound to relevant output channels, measuring signals on relevant channels, analysing the measurements, taking actions on the analysis results, e.g. performing automatic calibration or providing information to the user, etc.

When said measurement controller RCC comprises means for determining spatial information on the basis of said measurements, an advantageous embodiment of the present invention is obtained.

When said spatial information comprises information about the relative location of said passive loudspeakers, an advantageous embodiment of the present invention is obtained.

When said spatial information comprises information about acoustically substantially significant elements of the room, an advantageous embodiment of the present invention is obtained.

When said spatial information comprises information about an estimated listening position, an advantageous embodiment of the present invention is obtained.

When said spatial information comprises an estimated optimal listening position, an advantageous embodiment of the present invention is obtained.

When said spatial information comprises information about the relative order of at least three of said N passive loudspeakers arranged in a loudspeaker array, an advantageous embodiment of the present invention is obtained.

When said measurement controller RCC comprises means for determining room response information on the basis of said measurements, an advantageous embodiment of the present invention is obtained.

When said room response information comprises loudspeaker coloration responses A, B, C, D, E.

When said measurement controller RCC comprises a room correction controller RCC, an advantageous embodiment of the present invention is obtained.

According to an embodiment of the present invention, a room correction controller is provided as a specific species of a measurement controller. The room correction controller may control the establishment of measurements relevant for establishing information, e.g. coloration responses, related to acoustical deficiencies or undesired properties of the room, and further control the establishment of a correction or calibration that counteracts the deficiencies or undesired properties.

When said room correction controller RCC comprises means for establishing equalization target responses on the basis of said loudspeaker coloration responses A, B, C, D, E by application of a method of performing measurements according to any of the above, an advantageous embodiment of the present invention is obtained.

When said audio system comprises spatial information output means, an advantageous embodiment of the present invention is obtained.

When said audio system comprises room response information output means, an advantageous embodiment of the present invention is obtained.

According to an embodiment of the present invention, the audio system comprises means, e.g. a display, an output interface, etc., for providing the information obtained to the user or other equipment.

When said audio system comprises a room correctable audio system, an advantageous embodiment of the present invention is obtained.

According to a preferred embodiment of the present invention, the audio system is room correctable, i.e. it utilises the measurements and information obtained to facilitate correction of room deficiencies.

When said output stage comprises a room correcting output stage RCA; RCM, an advantageous embodiment of the present invention is obtained.

When said output stage RCA, RCM comprises an equalizer EQ, an advantageous embodiment of the present invention is obtained.

When said measurement controller RCC cooperates with said equalizer EQ in implementing said equalization target responses in said audio system, an advantageous embodiment of the present invention is obtained.

When said output stage RCA; RCM comprises a power amplifier PWA, an advantageous embodiment of the present invention is obtained.

According to the present invention, the power amplifier may be any kind of amplifier, i.e. class-A, class-B, class-C, class-D, class-E, or any other kind. In a preferred embodiment the amplifier is a PWM switching amplifier, preferably a self-oscillating PWM switching amplifier.

When said power amplifier PWA comprises means for measuring signals from loudspeakers used as; microphones, an advantageous embodiment of the present invention is obtained.

According to a preferred embodiment of the present invention, the power amplifier comprises means that allows measuring the signals on the output terminals without disconnecting them from the power amplifier meanwhile. In a preferred embodiment is even facilitated to measure on the output terminals while the power amplifier is delivering power to those output terminals simultaneously, i.e. facilitating measuring with a loudspeaker while it produces sound itself.

When said output stage RCA; RCM comprises a speaker microphone amplifier SMA comprising at least one input connected to at least one of said N loudspeakers, an advantageous embodiment of the present invention is obtained.

When said speaker microphone amplifier SMA comprises N inputs connected to said N loudspeakers, an advantageous embodiment of the present invention is obtained.

When said output stage RCA; RCM comprises input/output switches IOS for controlling which of said loudspeakers are acting as loudspeakers and which are acting as microphones, an advantageous embodiment of the present invention is obtained.

When said output stage RCA; RCM comprises means for determining relative distances between said N passive loudspeakers on the basis of impulse responses $y_{srs}(t)$ measured between pairs of said loudspeakers, an advantageous embodiment of the present invention is obtained.

When said measurement controller comprises means for performing cross correlation between output signals and input signals of said audio system, an advantageous embodiment of the present invention is obtained.

When said output stage RCA; RCM comprises means for determining spatial information on the basis of impulse responses $y_{srs}(t)$ measured between pairs of said loudspeakers, an advantageous embodiment of the present invention is obtained.

When said output stage RCA; RCM comprises means for determining spatial information on the basis of speaker-room-speaker responses $M_{srs}$; AB, AC, . . . , EC, ED measured between pairs of said loudspeakers, an advantageous embodiment of the present invention is obtained.

When said output stage RCA; RCM comprises means for determining loudspeaker coloration responses A, B, C, D, E on the basis of speaker-room-speaker responses $M_{srs}$; AB, AC, . . . , EC, ED measured between pairs of said loudspeakers, an advantageous embodiment of the present invention is obtained.

When said output stage RCA; RCM comprises means for establishing equalization target responses on the basis of said loudspeaker coloration responses, an advantageous embodiment of the present invention is obtained.

When said audio system comprises means for analysing measurements performed by using at least one of said loudspeakers for producing sound and at least one of said loudspeakers for measuring said sound, an advantageous embodiment of the present invention is obtained.

When said audio system comprises means for automatic room correction on the basis of analysing measurements performed by using at least one of said loudspeakers for producing sound and at least one of said loudspeakers for measuring said sound, an advantageous embodiment of the present invention is obtained.

When said measurement controller RCC is implemented in a measurement module RCM as an add-on to a common audio amplifier system, an advantageous embodiment of the present invention is obtained.

In a preferred embodiment of the present invention, a measurement module comprising a measurement controller according to the present invention, is provided for augmenting existing amplifiers. This facilitates owners of expensive, excellent and beloved amplifiers and passive loudspeaker systems to enhance their existing amplifier with a measurement module, and thereby enabling all the measurement and analysis features of the present invention without the need for dumping their existing equipment, as would often be necessary in order to take advantage of other solutions such as self-calibrated active speakers or test-microphone systems.

When said room correcting controller RCC is implemented in a room correcting module RCM as an add-on to a common audio amplifier system, an advantageous embodiment of the present invention is obtained.

According to an embodiment of the present invention, an existing beloved amplifier and passive loudspeaker system may by means of a room correcting module according to the present invention, be enhanced to facilitate automatic room correction or any of the other features of the present invention.

THE DRAWINGS

Figure 2:
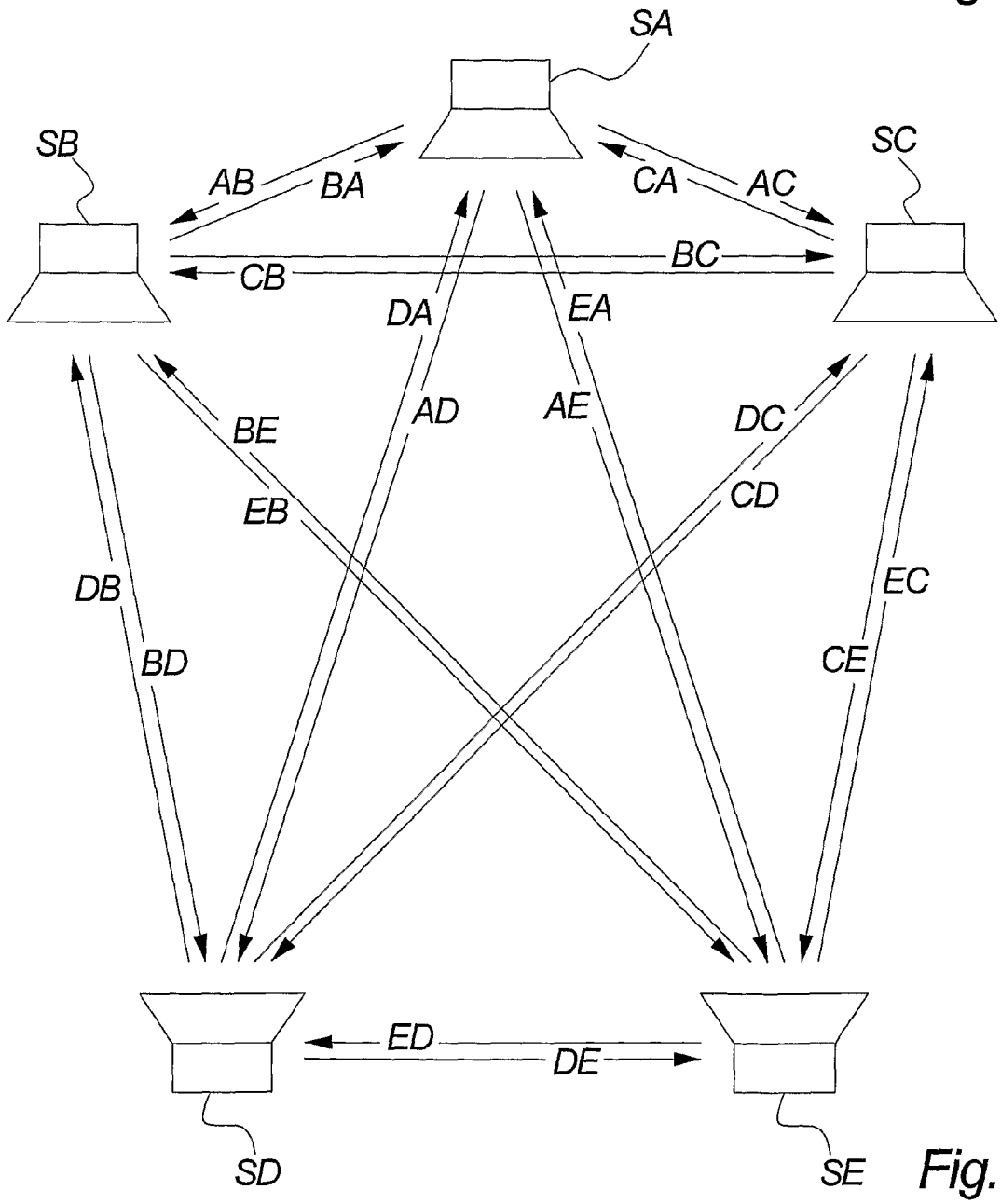
Figure 3:
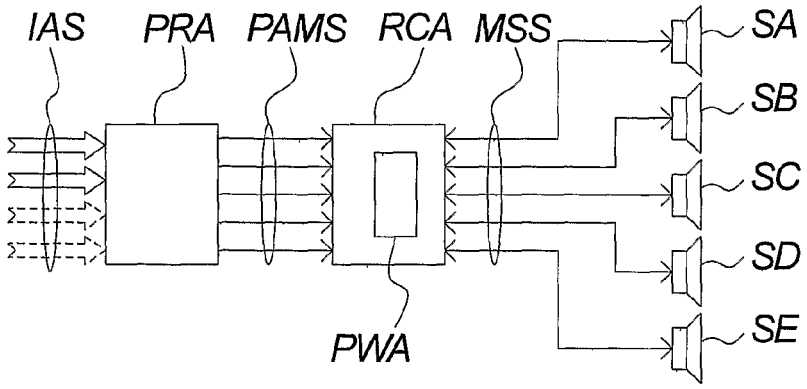
Figure 4:
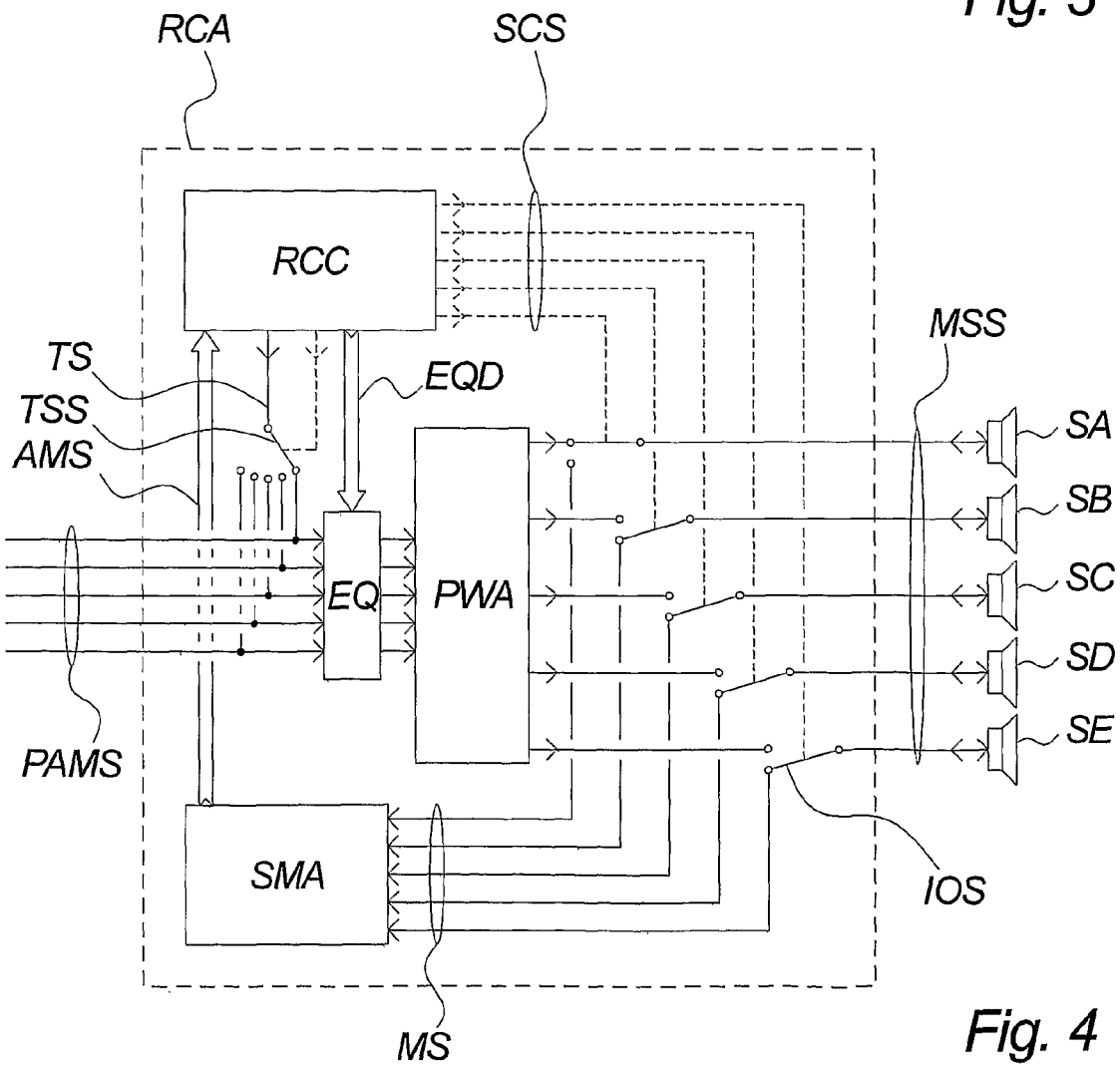
Figure 5:
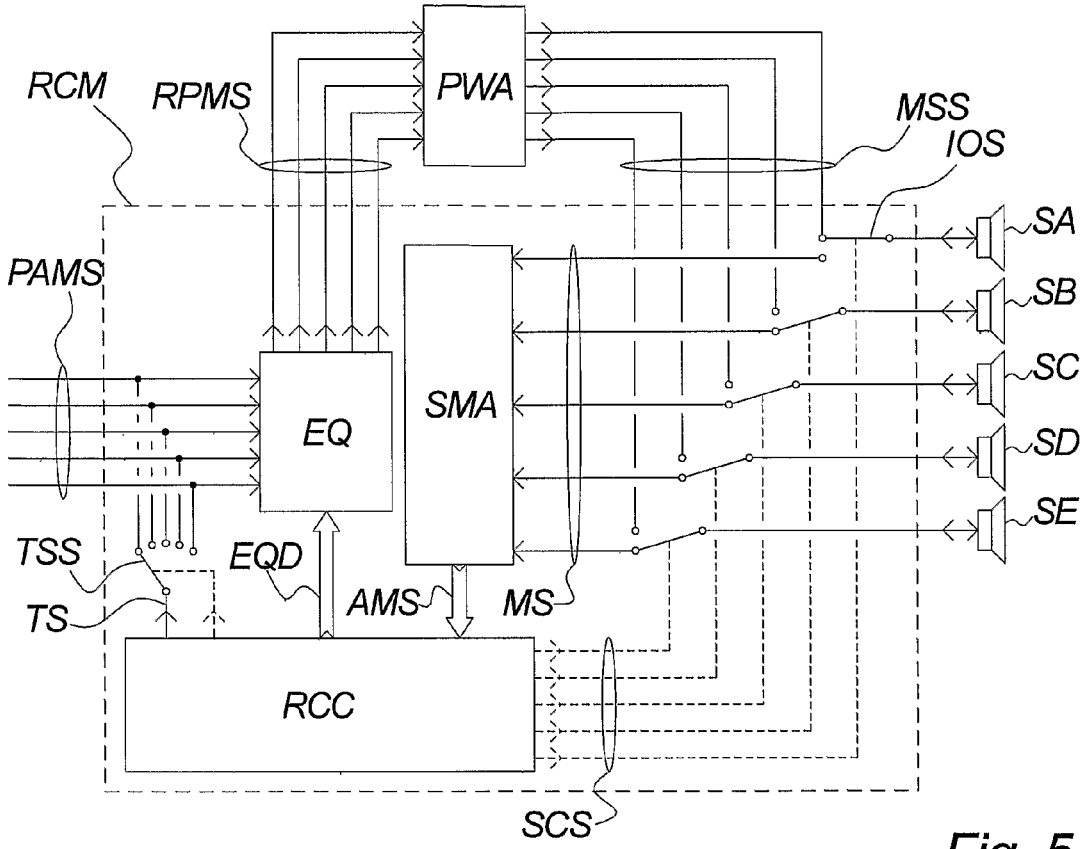
Figure 6:
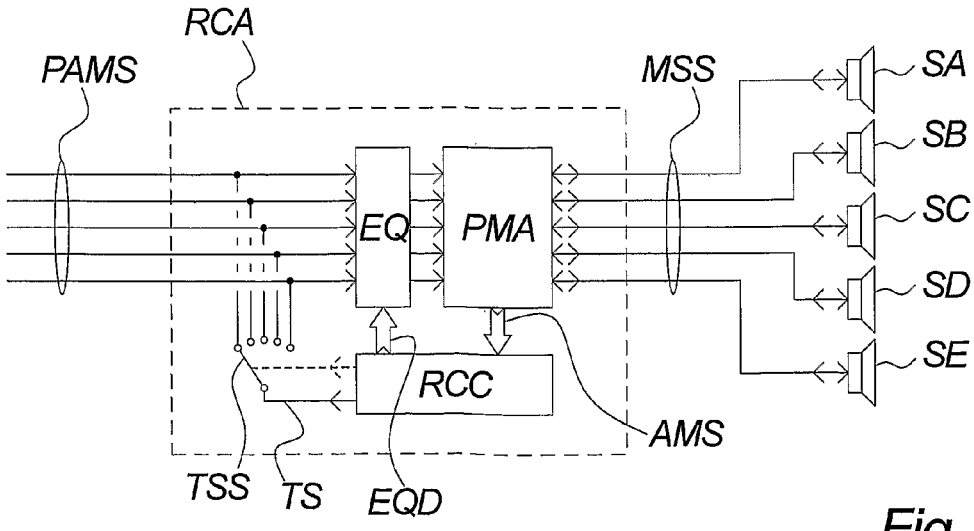
Figure 7A:
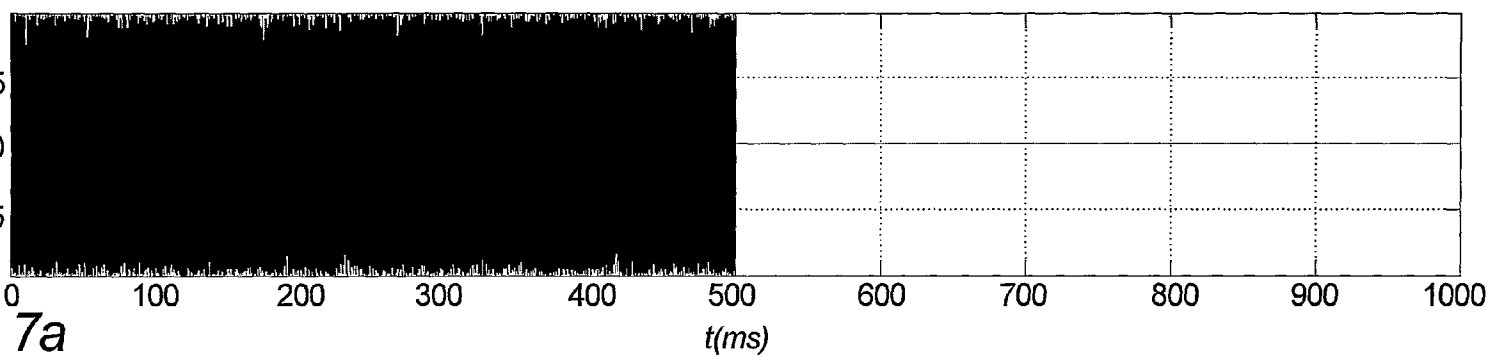
Figure 7B:
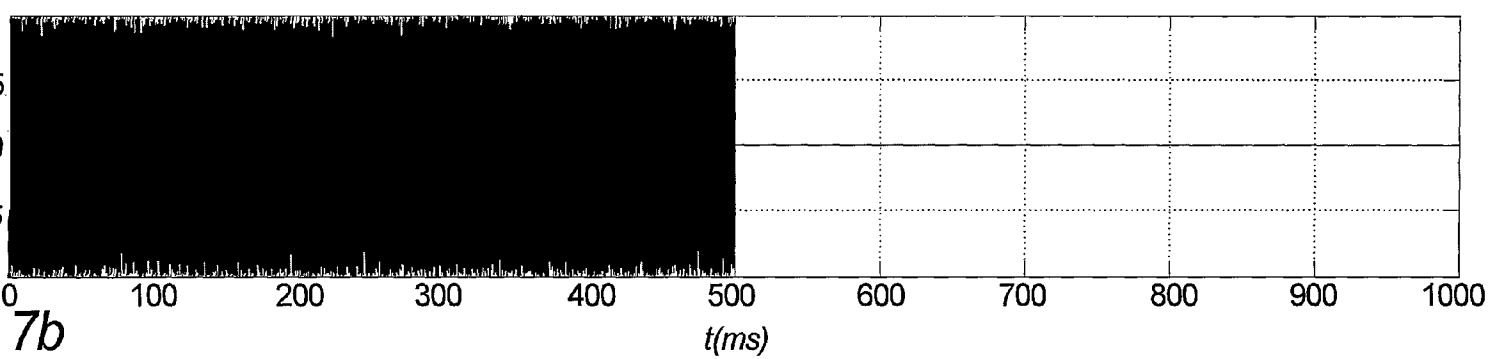
Figure 7C:
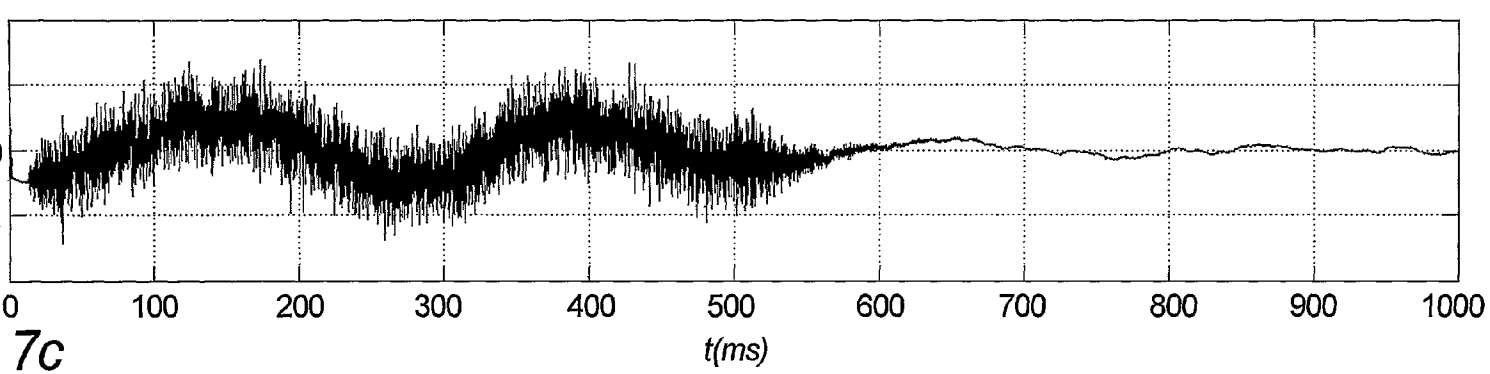
Figure 8A:
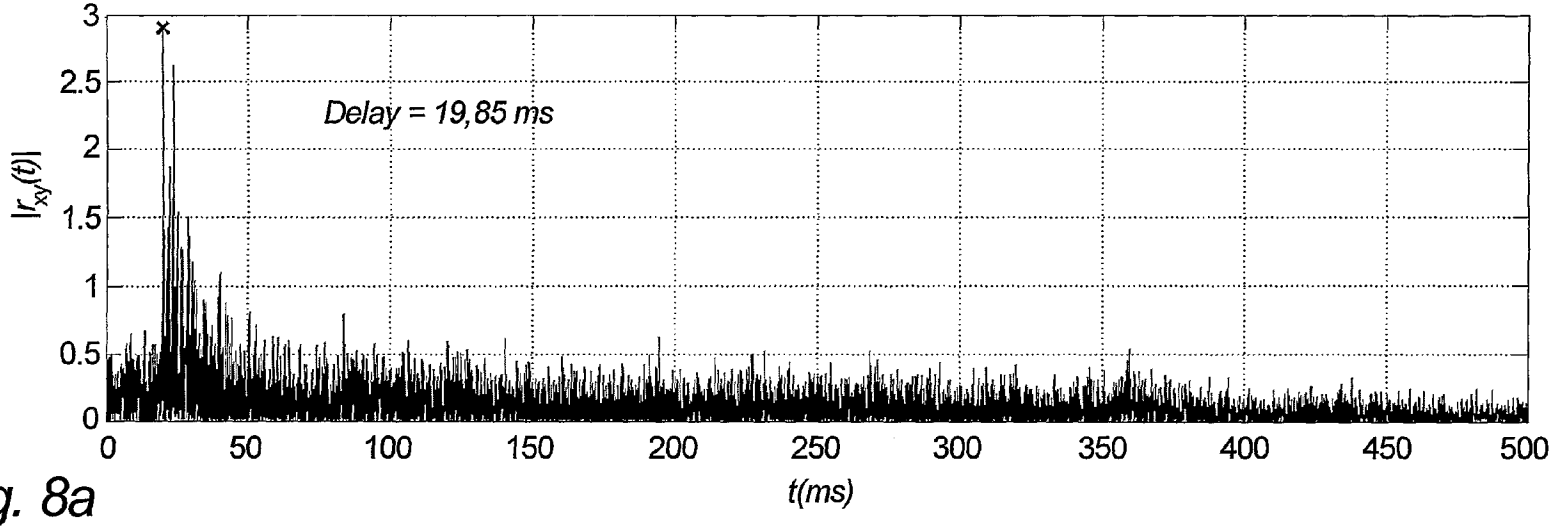
Figure 8B:
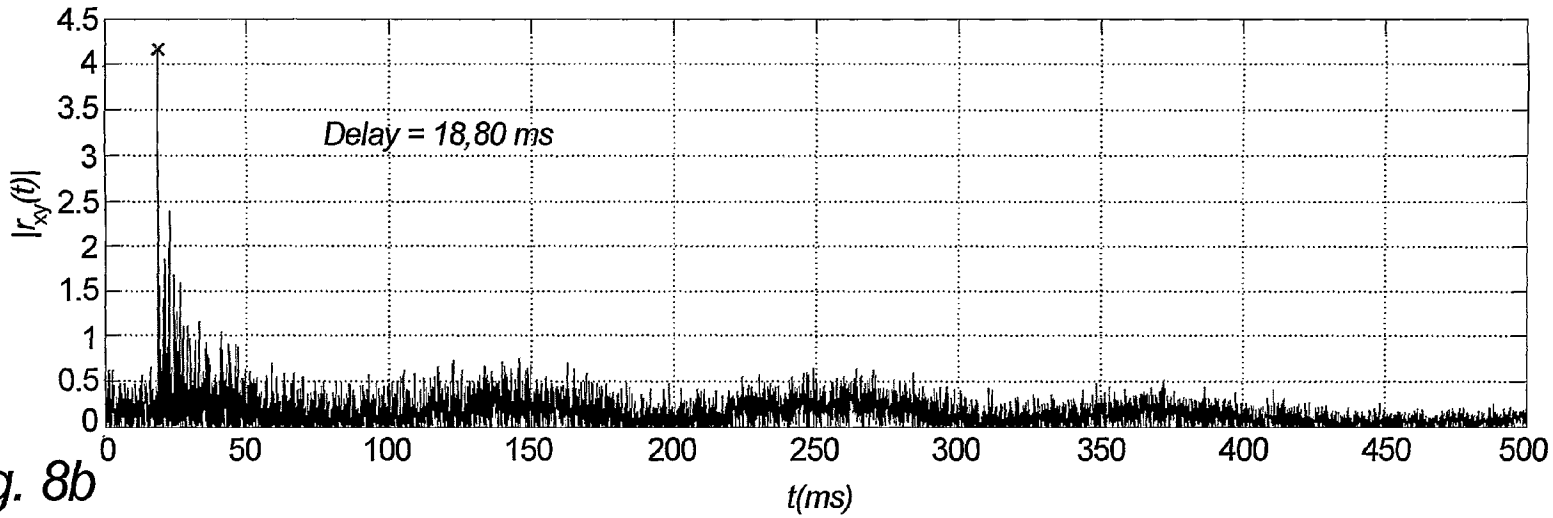
Figure 9:
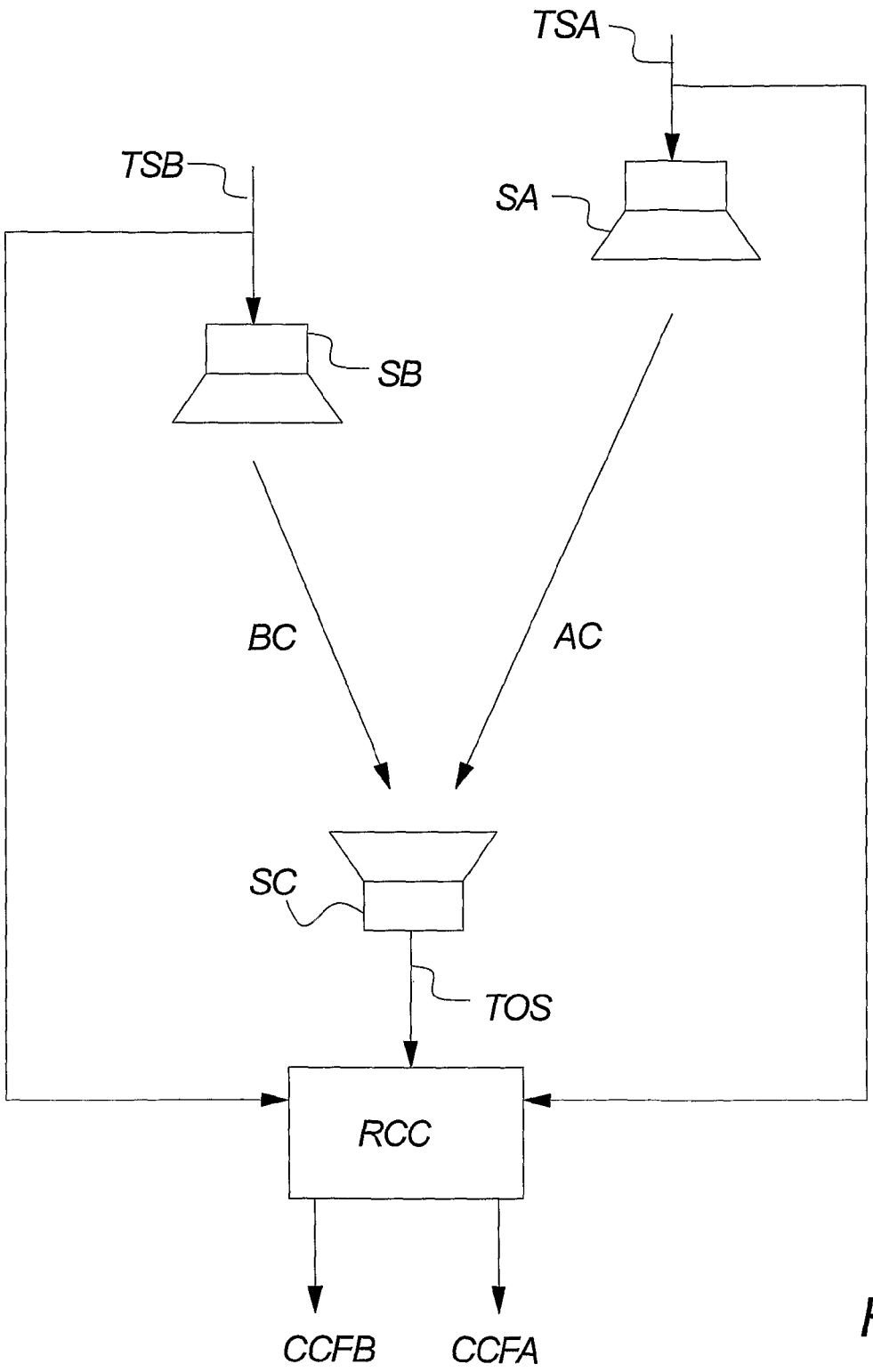
Figure 10:
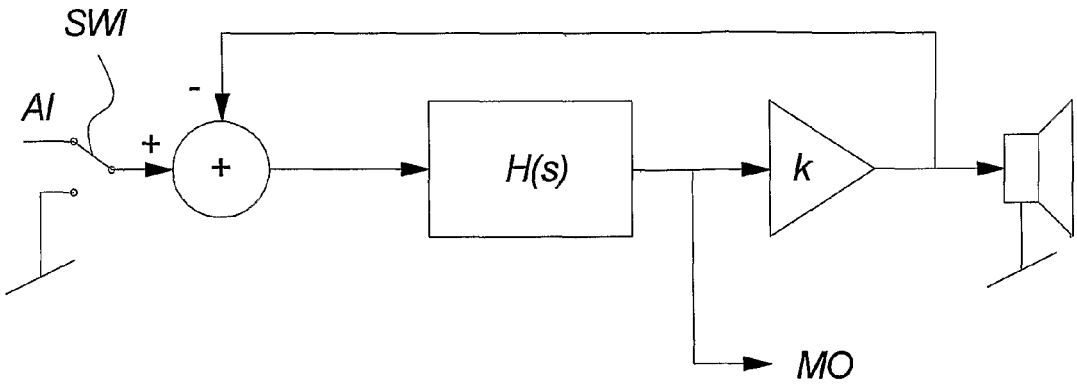
Figure 11:
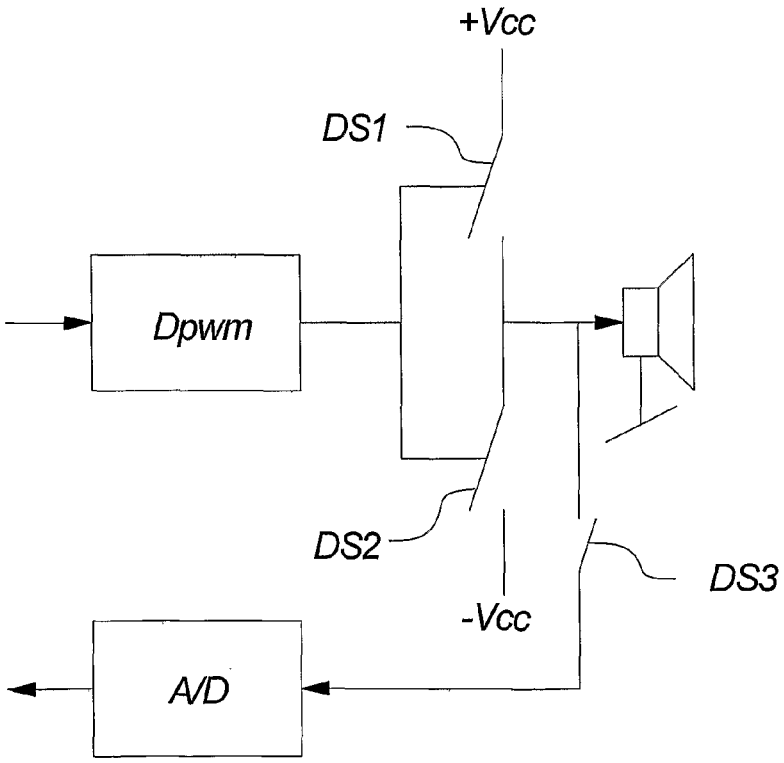

The invention will in the following be described with reference to the drawings where FIG. 1 illustrates a principle behind the present invention, FIG. 2 illustrates a 5-channel embodiment of a measurement method according to an embodiment of the present invention, FIG. 3 illustrates an embodiment of an audio system according to an embodiment the present invention, FIG. 4 illustrates an embodiment of a measuring or room correcting amplifier according to an embodiment the present invention, FIG. 5 illustrates a further embodiment of a measuring or room correcting module according to an embodiment the present invention, FIG. 6 illustrates yet a further embodiment of a measuring or room correcting amplifier according to an embodiment the present invention, FIGS. 7*a* and 7*b* illustrate examples of output test sounds utilised in an embodiment of the present invention, FIG. 7*c* illustrates an example of a measured signal in an embodiment of the present invention, FIGS. 8*a* and 8*b* illustrate examples of cross correlation functions established by an embodiment of the present invention, FIG. 9 illustrates a principle of the present invention, FIGS. 10*a* and 10*b* illustrate an embodiment of a measurement or room correcting amplifier according to an embodiment of the present invention, and FIG. 11 illustrates an embodiment of a measurement or room correcting amplifier according to an embodiment of the present invention.

DETAILED DESCRIPTION

The basic idea of the present invention is to obtain an audio system that is capable of measuring acoustical and spatial properties of the audio system and/or environment, hereunder a new class of room correction systems, the Self-Calibrating Multichannel Speaker/Amplifier System, by utilizing the duality of passive speaker systems: They act both as speakers and as microphones. This fact can be utilized to obtain useful measurements of loudspeaker/room frequency responses or delays between speakers without requiring the user to mess around with microphones and without replacing his/her existing passive speakers with active high-tech devices like the ABC-systems mentioned above. All that is required to achieve adaptive room correction via existing passive speakers is a replacement or augmentation of the traditional multichannel power amplifier with another box, the Measurement Amplifier, capable of measuring and analysing sound that is produced by speakers of the system, or in specific embodiments of the present invention, the Room Correcting Amplifier, capable of the following operations:

1. Measuring the transfer functions from the terminals of each of the N speakers, acting as a normal loudspeaker, to the terminals of each, or some, of the other speakers, acting as a microphone.
2. Analysing these up to N·(N−1) measurements obtaining N equalization (EQ) target responses
3. Implementing the EQ functions in the amplifier for subsequent Room-corrected operation of the sound system with all speakers acting normally as loudspeakers.

The advantageous measurement method of the present invention is based on the fact that it can be shown that electro-acoustic transducers such as loudspeakers have the same transfer function from voltage input to volume velocity output when used as normal loudspeakers, as they do from sound pressure input to short-circuit current output when used as a microphone, i.e.:

$$\begin{aligned} H_{u2q}(s) &\equiv \frac{q(s)}{u(s)} \\ &= \frac{i(s)}{p(s)} \\ &\equiv H_{p2i}(s) \end{aligned}$$

where $H_{u2q}(s)$ represents the transfer function from voltage input u(s) to volume velocity output q(s) for a loudspeaker, and $H_{p2i}(s)$ represents the transfer function from sound pressure input p(s) to short-circuit current output i(s) for the same loudspeaker. This principle is in the following referred to as the reciprocity of electro-acoustic transducers or loudspeakers.

It is noted that any reference to loudspeakers, speakers, speaker systems, loudspeaker systems, etc., is not limited to a single speaker unit, e.g. a single bass or tweeter unit, but may comprise several speaker units, e.g. a three-way speaker system comprising a bass unit, a mid-range unit and a tweeter unit and corresponding passive crossover network. Thus, the reciprocity principle is equally true for passive speaker systems comprising several speaker units and passive crossover network as it is for single speaker units.

A point source in free space, producing volume velocity q(s) creates a sound pressure p(s):

$$p(s) = q(s) \cdot s \frac{\rho}{4\pi r} \cdot e^{-s\frac{r}{c}}$$

where s is the "Laplace-domain" complex frequency, ρ is the air density, r is the distance from the point source to the observation point and c is the speed of sound. For frequency response, s should be replaced with jω, where $j=\sqrt{-1}$ and ω=2πf or magnitude-wise:

$$|p(\omega)| = |q(\omega)| \cdot \omega \frac{\rho}{4\pi r}.$$

Thus, a point-source loudspeaker with $H_{u2q}(s)=4\pi/\rho s$ would produce a voltage-to-sound pressure magnitude response $M_{spk}$ in free space at 1 meter of $$M_{spk}(\omega) \equiv \left| \frac{p_{1meter}(s)}{u(s)} \right|_{s=j\omega}$$

-continued $$= \left| s\frac{\rho}{4\pi} H_{u2q}(s) \right|_{s=j\omega}$$

$$= \left| s\frac{\rho}{4\pi}\frac{4\pi}{\rho s} \right|_{s=j\omega}$$

$$= 1\frac{\text{Pa}}{\text{V}}$$

Now, for use in the following discussions, a reference speaker is defined as

1. Being "point-source-like", that is: Small compared to the wavelengths of interest, and hence omnidirectional.
2. Having a voltage input u(s) to volume velocity output q(s) transfer function $$H_{u2q}(s) = \frac{4\pi}{\rho s}$$

and thus and "ideal" magnitude response at 1 meter distance of $$M_{spk}(\omega) = 1\frac{\text{Pa}}{\text{V}}$$

Such a reference speaker when applied in free space would produce a perfectly uncolored sound reproduction of a voltage signal applied to its input.

A hypothetical reference measurement setup may now be established as shown in FIG. 1 illustrating an audio system comprising two such reference loudspeakers LS1, LS2 placed in unbounded space with a distance D between them. One loudspeaker LS1 is connected to a conventional voltage source amplifier $u_1$ with an output impedance of 0Ω and the other loudspeaker LS2 is connected to a current measurement amplifier A with an input impedance of 0Ω.

The magnitude response from voltage input to current output of the hypothetical reference measurement system of FIG. 1 is thus:

$$\left|\frac{i_2(j\omega)}{u_1(j\omega)}\right| = |H_{u2q}(j\omega)| \cdot \omega\frac{\rho}{4\pi D} \cdot |H_{p2i}(j\omega)|$$

$$= \frac{4\pi}{\rho\omega} \cdot \omega\frac{\rho}{4\pi D} \cdot \frac{4\pi}{\rho\omega}$$

$$= \frac{4\pi}{\rho D\omega}$$

For symmetry reasons, i.e. the reciprocity principle described above, the input and output can be switched and the measured magnitude response will be the same:

$$\left|\frac{i_2(j\omega)}{u_1(j\omega)}\right| = \left|\frac{i_1(j\omega)}{u_2(j\omega)}\right|$$

The Speaker-Room-Speaker magnitude response $M_{srs}(\omega)$ of a system comprising two speakers in a room as shown in FIG. 1 may thus be defined as $$M_{srs}(\omega) \equiv \frac{\rho D\omega}{4\pi} \cdot \left|\frac{i_2(j\omega)}{u_1(j\omega)}\right|$$

where the indices 1 and 2 merely indicate "one speaker" and "the other speaker" of a pair of speakers.

For a perfect, uncolored setup as shown in FIG. 1 it can be found that $$M_{srs}(\omega)=1$$

Furthermore, the Speaker-Room-Speaker trans-admittance impulse response $y_{srs}(t)$ may be defined as $$y_{srs}(t) = IFT\left\{\frac{i_2(j\omega)}{u_1(j\omega)}\right\}$$

where IFT is the Inverse Fourier Transform.

A real measurement setup may now be established by replacing the ideal reference speakers described above regarding FIG. 1 with real, imperfect speakers or speaker systems possibly comprising several speaker units and cross-over networks. When one speaker LS1 in FIG. 1 is replaced with a real, imperfect directional speaker including its end of a real room, and the measurement is repeated, the Speaker-Room-Speaker magnitude response will not be 1, i.e. $M_{srs}(\omega)\neq 1$, but will instead reflect the total coloration of the new, real speaker LS1 and surroundings observed from the position of speaker LS2, in the following referred to as $\text{Col}_{LS1,LS2}(\omega)$. And because the above-mentioned reciprocity principle also applies to imperfect speakers and speaker systems, the measurement result will still be the same, whether measured from LS1 to LS2 or from LS2 to LS1. The imperfect speaker's directivity is also the same whether it is used as a speaker or a microphone.

If instead in FIG. 1 the second speaker LS2 is replaced with an imperfect, directional speaker and "its" end of the room, and the first speaker LS1 again being an ideal reference speaker, the Speaker-Room-Speaker magnitude response will again not be 1, but will reflect the coloration of the new speaker LS2 and the room observed from the position of the first speaker LS1, i.e. $\text{Col}_{LS2,LS1}(\omega)$.

If in FIG. 1 both ideal speakers LS1, LS2 are replaced with real speakers, or speaker systems, and placed in a real room, the measurement result will contain the product of the colorations of the first speaker LS1 with its "half-room" seen from position LS2 and that of the second speaker LS2 with its "half-room" seen from position LS1. And because the room in such a setup is closed, it will also include all the modal coupling between the two speakers, created by the room. Hence, the Speaker-Room-Speaker magnitude response may be considered the product of the speaker/room coloration of speaker LS1 seen from position LS2 and that of speaker LS2 seen from position LS1:

$$M_{srs}(\omega)=\text{Col}_{LS1,LS2}(\omega)\cdot\text{Col}_{LS2,LS1}(\omega)$$

The distance D occurring in some of the above equations may be found with good precision by analyzing the Speaker-Room-Speaker trans-admittance impulse response $y_{srs}(t)$ for the acoustical propagation delay Δt from speaker LS1 to speaker LS2 and applying the simple relation D=c·Δt, where c is the speed of sound.

Several interesting facts may be derived from alone knowing the distances D between the different speakers, e.g. information about the layout of the speaker setup, information about the order of several speakers arranged in a speaker array, etc.

In a room with an audio system with N channels, it is possible to measure N·(N−1) Speaker-Room-Speaker magnitude responses $M_{srs}$, i.e. magnitude responses from each speaker to all speakers except itself. FIG. 2 illustrates an example of the Speaker-Room-Speaker magnitude responses that are possible to measure in a typical 5-channel setup, i.e. N=5, as in a standard ITU-775 setup. It comprises 5 loudspeakers or speaker systems SA, SB, SC, SD, SE, e.g. comprising several speaker units and crossover networks. The possible Speaker-Room-Speaker magnitude responses are indicated in the drawing by the reference signs AB, AC, AD, AE, BA, BC, BD, BE, CA, CB, CD, CE, DA, DB, DC, DE, EA, EB, EC and ED, where AB corresponds to a measurement from speaker SA to speaker SB, AC corresponds to a measurement from speaker SA to speaker SC, etc. Hence, e.g. the magnitude responses AB and BA involve the same two speakers SA and SB, but AB is measured from speaker SA to speaker SB, whereas BA is measured from speaker SB to speaker SA.

Each Speaker-Room-Speaker magnitude response $M_{srs}$ may still be interpreted as the product of two coloration responses, however not separately physically measurable, as for example:

$$AB(\omega)=\mathrm{Col}_{SA,SB}(\omega)\mathrm{Col}_{SB,SA}(\omega)$$

$$AC(\omega)=\mathrm{Col}_{SA,SC}(\omega)\mathrm{Col}_{SC,SA}(\omega)$$

etc.

In this respect, each speaker SA . . . SE, has not one but N−1 coloration responses, one for each observation point, i.e. speaker acting as microphone. In order to be able to handle the coloration responses which may have degrading effect on the sound in the room, the assumption is made that the coloration of each speaker is independent of the point of observation and these individual coloration responses are thus referred to as A(ω) for the coloration response of speaker SA, B(ω) for the coloration response of speaker SB, C(ω) for speaker SC, D(ω) for speaker SD and E(ω) for speaker SE.

The Speaker-Room-Speaker magnitude responses are thus:

$$AB(\omega)=A(\omega)B(\omega)$$

$$AC(\omega)=A(\omega)C(\omega)$$

etc.

It is now possible to find such N individual coloration responses, A(ω), B(ω), etc., that best fit the N·(N−1) Speaker-Room-Speaker magnitude responses actually measured.

By converting all responses to decibel and writing out the equations, it can be seen that the N·(N−1) measurements make a linear equation system in the dB-coloration-magnitude responses. This equation system for a multi-channel audio system with N=5 as in FIG. 2 is shown below, where A is short hand for 20 $\log_{10}(A(\omega))$, AB is short hand for 20 $\log_{10}(AB(\omega))$, etc.

$$\begin{bmatrix} A+B \\ A+C \\ A+D \\ A+E \\ B+A \\ B+C \\ B+D \\ B+E \\ C+A \\ C+B \\ C+D \\ C+E \\ D+A \\ D+B \\ D+C \\ D+E \\ E+A \\ E+B \\ E+C \\ E+D \end{bmatrix} = \begin{bmatrix} AB \\ AC \\ AD \\ AE \\ BA \\ BC \\ BD \\ BE \\ CA \\ CB \\ CD \\ CE \\ DA \\ DB \\ DC \\ DE \\ EA \\ EB \\ EC \\ ED \end{bmatrix} \Leftrightarrow \begin{bmatrix} 1 & 1 & 0 & 0 & 0 \\ 1 & 0 & 1 & 0 & 0 \\ 1 & 0 & 0 & 1 & 0 \\ 1 & 0 & 0 & 0 & 1 \\ 1 & 1 & 0 & 0 & 0 \\ 0 & 1 & 1 & 0 & 0 \\ 0 & 1 & 0 & 1 & 0 \\ 0 & 1 & 0 & 0 & 1 \\ 1 & 0 & 1 & 0 & 0 \\ 0 & 1 & 1 & 0 & 0 \\ 0 & 0 & 1 & 1 & 0 \\ 0 & 0 & 1 & 0 & 1 \\ 1 & 0 & 0 & 1 & 0 \\ 0 & 1 & 0 & 1 & 0 \\ 0 & 0 & 1 & 1 & 0 \\ 0 & 0 & 0 & 1 & 1 \\ 1 & 0 & 0 & 0 & 1 \\ 0 & 1 & 0 & 0 & 1 \\ 0 & 0 & 1 & 0 & 1 \\ 0 & 0 & 0 & 1 & 1 \end{bmatrix} \begin{bmatrix} A \\ B \\ C \\ D \\ E \end{bmatrix} = \begin{bmatrix} AB \\ AC \\ AD \\ AE \\ BA \\ BC \\ BD \\ BE \\ CA \\ CB \\ CD \\ CE \\ DA \\ DB \\ DC \\ DE \\ EA \\ EB \\ EC \\ ED \end{bmatrix} \Leftrightarrow$$

$$M\begin{bmatrix} A \\ B \\ C \\ D \\ E \end{bmatrix} = \begin{bmatrix} AB \\ AC \\ AD \\ AE \\ BA \\ BC \\ BD \\ BE \\ CA \\ CB \\ CD \\ CE \\ DA \\ DB \\ DC \\ DE \\ EA \\ EB \\ EC \\ ED \end{bmatrix},$$

-continued $$\text{where } M = \begin{bmatrix} 1 & 1 & 0 & 0 & 0 \\ 1 & 0 & 1 & 0 & 0 \\ 1 & 0 & 0 & 1 & 0 \\ 1 & 0 & 0 & 0 & 1 \\ 1 & 1 & 0 & 0 & 0 \\ 0 & 1 & 1 & 0 & 0 \\ 0 & 1 & 0 & 1 & 0 \\ 0 & 1 & 0 & 0 & 1 \\ 1 & 0 & 1 & 0 & 0 \\ 0 & 1 & 1 & 0 & 0 \\ 0 & 0 & 1 & 1 & 0 \\ 0 & 0 & 1 & 0 & 1 \\ 1 & 0 & 0 & 1 & 0 \\ 0 & 1 & 0 & 1 & 0 \\ 0 & 0 & 1 & 1 & 0 \\ 0 & 0 & 0 & 1 & 1 \\ 1 & 0 & 0 & 0 & 1 \\ 0 & 1 & 0 & 0 & 1 \\ 0 & 0 & 1 & 0 & 1 \\ 0 & 0 & 0 & 1 & 1 \end{bmatrix}$$

A similar equation system can be established for group-delay responses, if desired.

The above, linear equation system has the least-squares optimal solution:

$$\begin{bmatrix} A \\ B \\ C \\ D \\ E \end{bmatrix} = (M^T M)^{-1} M^T \begin{bmatrix} AB \\ AC \\ AD \\ AE \\ BA \\ BC \\ BD \\ BE \\ CA \\ CB \\ CD \\ CE \\ DA \\ DB \\ DC \\ DE \\ EA \\ EB \\ EC \\ ED \end{bmatrix} = R \begin{bmatrix} AB \\ AC \\ AD \\ AE \\ BA \\ BC \\ BD \\ BE \\ CA \\ CB \\ CD \\ CE \\ DA \\ DB \\ DC \\ DE \\ EA \\ EB \\ EC \\ ED \end{bmatrix}, \text{ where } R = (M^T M)^{-1} M^T$$

$M^T$ indicates the transpose of the matrix M. Note that R can be calculated in advance, which may decrease the necessary calculations significantly. The solutions A, B, C, D, and E represent the least-squares average coloration log-magnitude responses in decibel of each speaker as observed from the positions of the other speakers. In an alternative embodiment the N·(N−1) equations are weighted before solving the equation system, in order to give more weight to some measurements than others.

Hence, as the average coloration log-magnitude responses A, B, C, D, and E represent average considerations of several actual responses at different locations, and as in most setups, homes, studios, etc., the listening positions are typically located within an area surrounded by the available speakers, of course in a degree depending on the number of speakers if N is small, the average coloration log-magnitude responses A, B, C, D, and E may presumably match the actual responses at the listening position(s) better than a standard flat response used when no knowledge about the room or speakers exists.

It is noted that the above example concerning a 5-channel system, i.e. N=5, may straightforwardly be extended to comprise any number equal to or greater than 3 channels N. The amount of processing is, however, increased significantly by each additional channel, as the number of measurements correspond to the number of channels by $M_{srs}$=N·(N−1), as mentioned above.

If N is less than 3, the above analysis method does not apply in its full extent. When N is zero or 1 it is obviously impossible to do any Speaker-Room-Speaker measurements, as there is no or only one speaker. In the event where N=2, i.e. in a stereo system, the equation system is singular and an individual coloration response for each speaker is impossible to derive. The equation system to solve in that situation is:

$$\begin{bmatrix} A+B \\ B+A \end{bmatrix} = \begin{bmatrix} AB \\ BA \end{bmatrix} \Leftrightarrow \begin{bmatrix} 1 & 1 \\ 1 & 1 \end{bmatrix} \begin{bmatrix} A \\ B \end{bmatrix} = \begin{bmatrix} AB \\ BA \end{bmatrix}$$

and hence, when calculating R by, e.g., the pinv( ) function in MATLAB® version 7 from The MathWorks, Inc.:

$$M = \begin{bmatrix} 1 & 1 \\ 1 & 1 \end{bmatrix} \text{ and } R = \begin{bmatrix} 0.25 & 0.25 \\ 0.25 & 0.25 \end{bmatrix}$$

From this, a sensible compromise for the coloration responses when only two speakers are available for measurements may be established as:

$$A = B = \frac{AB + BA}{4}$$

Thereby two identical coloration responses are established, representing an average of the two actual coloration responses. In most cases an equalization based on this average is better than no equalization, as speakers in a stereo setup typically are positioned under somewhat similar conditions, due to the symmetry of the stereo standard setup.

According to the reciprocity principle it could be expected that AB=BA, AC=CA, etc., thereby causing half the measurements to be redundant. However, this would in a preferred, practical embodiment only reduce the measurement time by a factor (N−1)/N since a test signal would still have to be transmitted from all but the last speaker. Furthermore, by actually carrying out the redundant measurements in a preferred embodiment of the invention, the system becomes more resistant to noise and nonlinearity problems, as each response is inherently measured twice. Moreover, the reciprocity principle does not apply to pairs of nonlinear speakers unless they are identical.

It is noted that instead of solving the equation system based on the amplitude characteristics of the responses, it is possible to solve it based on the complex responses, i.e. frequency characteristics of the responses. Thereby an equation system for the amplitude parts and a similar equation system for the phase or group-delay parts is achieved.

By the above described advantageous methods and measurement setups, an actual representation for each speaker's coupling to the actual room may be established by using the existing, passive speakers for both test signal rendering and measuring. Also the room modes may be determined directly on the basis of the Speaker-Room Speaker trans-admittance impulse responses $y_{srs}(t)$.

Experiments performed with a standard ITU-775 5-channel speaker setup, where measurements according to the above-described method and measurements with a microphone in the listening position were carried out, showed significant correlation in the low frequency range below 500 Hz between the coloration log-magnitude responses given by a method according to the present invention and the log-magnitude responses obtained by the microphone measurement.

For using the established coloration log-magnitude responses A, B, etc., to counteract the sound degradations caused by boundary effects, room modes, etc., they may be used as a basis for establishing equalization filters for each audio channel, which again may be implemented into the audio system.

The coloration log-magnitude responses A, B, etc., may be processed, e.g. in order to deal with specific defects of the room or speakers, obtain particular effects, ease the subsequent processing, fit to predefined equalization resolution or presets, etc., e.g. by smoothing, filtering, limiting, editing, etc. The possibly modified responses may then be subtracted from predefined or user-defined desired system target log-magnitude responses, e.g. the responses that the audio system manufacturer designed the system towards, and thereby establishing an equalization target response for each speaker channel. These equalization target responses may in a preferred embodiment be automatically implemented in the audio system amplifier, but may in alternative embodiments be provided to the user as suggestions, possibly open for modification by the user.

Sound degradation due to room modes may further be handled by modal equalization where the frequency domain poles of the room are cancelled with zeros and new poles are electronically placed at the same frequencies, but with damping factors corresponding to the room's overall low-frequency decay time. As mentioned above, a method according to the present invention may be used for determining the room modes. The task of establishing suitable equalization target responses for handling the room modes may, e.g., be done according to the disclosures of Matti Karjalainen and Rhonda Wilson in the documents Mäkivirta, Karjalainen et al.: "Low-Frequency Modal Equalization Of Loudspeaker-Room Responses", AES Convention Paper 5480, hereby incorporated by reference, Karjalainen et al.: "Estimation of Modal Decay Parameters from Noisy Response Measurements", JAES Vol. 50 No. 11, November 2002, hereby incorporated by reference, Karjalainen et al.: "Frequency-Zooming ARMA Modeling of Resonant and Reverberant Systems", JAES Vol. 50 No. 12, December 2002, hereby incorporated by reference, and Rhonda J Wilson et al.: "The Loudspeaker-Room Interface—Controlling Excitation of Room Modes", Presented at 23rd International AES Conference, Copenhagen, Denmark, May 23-25, 2003, hereby incorporated by reference.

Above has been described in detail a method of obtaining information about coloration responses of each speaker in a multi-channel system, establishing corresponding equalization target responses on there basis thereof in order to counteract acoustical deficiencies of the room, etc.

It is noted that the measurements performed by utilising the principle of the present invention, i.e. using the passive loudspeakers as microphones, may lead to several other kinds of information, by performing other kinds of analysis or measurements than described above. All such measurements and analysis thereof for any purpose is within the scope of the present invention.

For example, if it is desired only to obtain a direct measure of the distance D between the two loudspeakers LS1 and LS2 it is possible to use a cross-correlation technique. This technique does not involve complicated coloration calculations and therefore does not require the same amount of computational power.

For the example where LS1 acts as a loudspeaker and LS2 acts as a microphone, a cross correlation function between the voltage input terminals on LS1 and the short-current output signal on the terminals of LS2 will show an absolute maximum, or a "peak", located on the time-axis of the cross correlation function, indicating the total signal delay between input terminals of LS1 to output terminals of LS2 plus a delay occurring from post processing of the signals such as input buffer delay, converter delay or like.

As the post processing delay is expected to be known or can be considered insignificant the distance D can be found, again by applying the simple relation $D=c\cdot\Delta t$, where c is the speed of sound and $\Delta t$ in this case is the measured total signal delay time from the cross correlation function subtracted by the post processing delay.

The cross correlation technique is not sensitive to the direction and can therefore also be applied for the opposite to the above described case, where LS1 acts as a microphone and LS2 acts as a loudspeaker.

A preferable setup for doing distance D measurements according to the above described cross correlation example comprises a signal transmitter outputting a well known and well defined voltage test signal on the input terminals of the speaker dedicated to act as speaker. The test signal is preferably a white noise signal, but can be e.g. a sine sweep, a logarithmic-frequency sine sweep, through the audio band, or a predetermined part thereof. Alternatively the test signal comprises a maximum length sequence, typically referred to as MLS, or noise, e.g. pink noise, music, speech or other relevant audio. In yet a further embodiment, no distinct test signal is provided. Instead the measurements are performed on the audio currently being provided by an active audio source connected to said speaker.

For audio systems comprising N loudspeakers i.e. LS1 to LSN, it is possible to measure $N\cdot(N-1)$ Speaker to Speaker cross correlations functions as described above i.e. cross correlations functions from each speaker acting as microphone to all speakers except itself acting as signal transmitter. As the distance from LS1 to LS2 is the same as from LS2 to LS1, the number of needed measurements, and hereby cross correlation calculations, is only $(N-1)!$. By post processing said $(N-1)!$ cross correlation functions, a spatial mapping of the locations of all N loudspeakers relative to each other can be achieved. For obtaining the necessary measurements, two or more loudspeakers may even produce sound simultaneously, provided they produce mutually distinctive sound, whereby the required number of sound bursts that disturbs the listener is minimized. In a preferred embodiment, the sound bursts comprises 50 ms of white noise, which is established independently for each loudspeaker so that the white noise from different speakers is different, which enables the cross correlation functions to disregard the noise from the other speakers.

Further examples of measurements and information that may be obtained by using the present invention in audio systems with passive loudspeakers comprises, but is not limited to the following:

- Determining the location of acoustically significant objects such as walls, big furniture, broad door openings, etc. Such information may be determined by analysing the early reflections of a test sound measured by the different speakers. Together with establishing a layout of the actual speaker setup on the basis of distances D, the information about acoustically significant objects in the room enables the generation of a complete acoustical image of the room. The analysis of early reflections may also be used for determining a mirror image source model of the room.
- Estimating the listening position on the basis of the speaker setup determined on the basis of the measured distances D. The position of the listener may be used to weigh the coloration responses when establishing equalization target responses to correct the room. Alternatively, the system may suggest an optimal listening position to the user, or even adaptively and intelligently suggest speaker location optimization to the user of the system.
- Simulating generic room types or specific popular concert halls, etc., by using the established coloration responses and acoustical image of the room for neutralizing the room's own acoustical response, and instead apply equalization target responses that creates a new acoustical response that simulates, e.g., a generic church room or the Sydney Opera House.
- Ordering the speakers in large speaker setups, e.g. in public address PA systems, by their distance to a reference speaker, and thereby validate that the speakers are correctly located. The system may further calibrate the delays applied to the different channels, and/or be used to determine if a speaker doesn't work at all, e.g. because of missing or faulty cabling, as the other speakers will then not measure anything but background noise for that speaker.
- Validating speaker setups, e.g. according to an expected setup provided to the system by the user. The system is able to compare the determined setup and distance measurements, while also being able to distinguish the different channels, e.g. centre speaker, left surround speaker, etc., with a "map" provided by the user. If the user by accident switched, e.g. the centre speaker and the left surround speaker, the system can tell so.
- Etc.

The present invention further comprises systems for performing the above-described methods for measuring and analysing in order to determine information about acoustical and/or spatial properties, e.g. the coloration log-magnitude responses and establishing suitable equalization target responses and to perform a spatial mapping of the location of loudspeakers relative to each other. When the method of the present invention is merely used for test-purposes and for one-time calibration, it may be possible to set up separate test equipment, comprising a test signal generator and an amplifier for pre-processing the signals established by the loudspeakers acting as microphones. As the present invention, however, especially aims at providing automatic room correction or other run-time or regularly provided information to ordinary sound system setups, which are typically rarely modified or even permanent, e.g. the sound systems in people's living rooms, in cinemas, in conference rooms, etc., examples of embodiments where the measurement and automatic room correction method is implemented in sound reproduction systems will be described in the following.

FIG. 3 illustrates an embodiment of the present invention. It comprises a number of input audio signals IAS, e.g. derived from CD-players, tuners, televisions, etc., and a pre-amplifier PRA taking these signals as inputs and establishing pre-amplified multi-channel signals PAMS, e.g. 5 signals corresponding to 5 channels in a multi-channel setup. The pre-amplified multi-channel signals PAMS are input to a measurement or room correcting amplifier RCA, which comprises a power amplifier PWA for establishing multi-channel speaker signal MSS on the basis of the pre-amplified signals PAMS. The speaker signals MSS are sent to the speakers SA, SB, SC, SD, SE, where they are rendered into sound. FIG. 3 comprises, as an example, 5 channels and 5 speakers, but may comprise any number of channels and speakers. The sources that establish the input audio signals IAS may be any sources, e.g. any common audio sources found in ordinary homes, e.g. CD-players, tape decks, turntables, tuners, VCR- or DVD-players, televisions, computers, minidisk players, microphones, etc., e.g. more advanced audio sources usually utilised in cinemas, studios, conference rooms, etc., or any other audio source. The pre-amplifier PRA may be any kind of pre-amplifier and preferably facilitates selection of audio source, predefined and/or user defined adjustment of audio properties, e.g. according to the type of audio source, possibly decoding a predefined or user defined multi-channel format, e.g. Dolby Digital, and initial amplification to a standard line level. The pre-amplifier may be any conventional pre-amplifier with any common or uncommon functionality. The speakers SA, SB, SC, SD, SE, may be any passive speakers, where by the term passive speaker is referred to any speaker that has the capability of acting as microphone, i.e. any speaker or speaker system, with or without crossover networks, with any number of sound transducers that cause a signal to be established on its input terminals when exposed to sound pressure. Typically, all speakers with passive crossover networks comply with this definition.

Hence, for the embodiment illustrated in FIG. 3, any audio sources, any pre-amplifiers and any passive speakers may be used with the present invention, thereby facilitating the preservation of the user's old, trusted and probably expensive passive loudspeakers and other audio gear while still obtaining the possibility of making measurements and automatic room correction by only exchanging their power amplifier with a measurement or room correcting amplifier according to the present invention comprising a power amplifier. In a less preferred embodiment of the present invention, any power amplifier may be used and the additional elements of the measurement or room correcting amplifier simply be built onto the existing power amplifier.

In addition to a power amplifier and multi-channel speaker signal outputs, the measurement or room correcting amplifier RCA comprises means for measuring signals from the speakers, means for processing a number of measurements in order to establish cross correlation functions, impulse responses, Speaker-Room-Speaker responses $M_{srs}$, etc., and, in turn, higher level information such as distances, coloration log-magnitude responses A, B, etc., and, yet in turn, for room correcting embodiments of the invention, equalization target responses for each speaker channel, and means for applying these equalization target responses to the pre-amplified multi-channel signals PAMS. Hence, in order to improve a common sound system into a system with measurement capabilities or even automatic room correction, the power amplifier has to be substituted with a measurement or room correcting amplifier according to the present invention, or at least be upgraded to resemble such a measurement or room correcting amplifier.

It is noted, that in the following examples of embodiments according to the invention are described in the context of room correcting systems, i.e. systems that utilises the methods described above to establish equalization parameters that corrects acoustical deficiencies of the room. Hence, the amplifier is denoted a room correcting amplifier, the controller is denoted a room correcting controller, etc. According to the present invention, and as described above, other uses than room correction are within the scope of the invention, and does not necessarily require a room correcting amplifier, e.g. in order to measure sound, calculate cross correlation functions, distances D, and establish an image of the loudspeaker setup. In such systems the amplifier is merely denoted a measurement amplifier, the controller a measurement controller, etc., but as mentioned, is perfectly within the scope of the present invention. Thus any of the below-described embodiments of amplifiers facilitating room correction, may as well be used for the other purposes described above. In some of these embodiments, the amplifier will become a littler simpler to implement, as, e.g., no control of an equalizer is necessary. Instead some embodiments require output means for providing the established information to the user.

An embodiment of a measurement or room correcting amplifier RCA according to an embodiment of the present invention is illustrated in FIG. 4. It comprises the output PAMS from the pre-amplifier PRA, a multi-channel power amplifier PWA outputting multi-channel speaker signals MSS, and speakers SA, SB, SC, SD, SE. A measurement or room correction controller RCC is provided for controlling the process of the automatic room correction, a speaker measurement amplifier SMA is provided for pre-processing, i.e. amplifying the weak measurement signals MS received from speakers acting as microphones, and an equalizer EQ is provided for applying established equalization target responses to the audio channels. In order to control which speakers act as speakers and microphones, respectively, a set of input/output switches IOS, e.g. relays, are provided at the output of the power amplifier PWA. These switches are controlled by the room correction controller RCC by means of switch control signals SCS. In a first position, an input/output switch IOS connects the corresponding speaker to a power amplifier output and thus provides the speaker with a multi-channel speaker signal MSS. In a second position, an input/output switch connects the corresponding speaker to a speaker measurement amplifier input and thus provides the amplifier with a measurement signal MS. Thus, when automatic room correction measurements are not performed, and the room correcting amplifier RCA is only being used as a conventional power amplifier, all input/output switches should be in the first position, conveying all signals directly through to the speakers. When measurements are performed, the room correction controller should control the switches according to the measurement procedure.

The room correction controller RCC preferably comprises a central processing unit CPU, a digital signal processor DSP, a microprocessor, or any other means for carrying out a digital measurement and analysis process, together with control of external circuits, possibly establishment of sound signals, etc. In alternative embodiments, the room correction controller RCC comprises one or more of several processors, logic circuits, converters, analog circuits, etc., each dedicated to perform or control one or more of the tasks assigned to the room correction controller RCC.

As described above, in a preferred embodiment $N\cdot(N-1)$ measurements are made, i.e. two for each possible speaker pair, i.e. one in each direction. In a preferred embodiment, these measurements are performed by first letting the first speaker, e.g. speaker SA, output a test signal, while the other, e.g. four, speakers are acting as microphones and thus establish measurement signals. This is repeated for each speaker, i.e. five times in the present example, whereby 20 measurements are obtained, again according to the present example with five channels. The test signal TS is in the embodiment of FIG. 4 controlled by the room correction controller RCC, which establishes a test signal TS that is coupled to the relevant audio channel by means of a test signal switch TSS, also controlled by the room correction controller RCC. In an alternative embodiment, the test signal may be coupled to all audio channels simultaneously as the irrelevant channels are not connected to the speakers while the measurements are done. According to a preferred embodiment, the test signal is a sine sweep, e.g. a logarithmic-frequency sine sweep, through the audio band, or a predetermined part thereof. In an alternative embodiment, the test signal comprises a maximum length sequence, typically referred to as MLS, or noise, e.g. pink noise. When used for distance measurements using cross correlation, the test signal is preferably white noise. In further alternative embodiments, the test signal comprises music, speech or other relevant audio. In yet a further embodiment, no distinct test signal is provided. Instead the measurements are performed on the audio currently being provided by the active audio source through the pre-amplifier and the pre-amplified multi-channel signal PAMS. In such case, the room correction controller RCC must have access to the pre-amplified multi-channel signal PAMS or the output of the speaker channel currently used for producing the test sound in the room in order to be able to compare the measured values with the test signal.

The speaker measurement amplifier SMA receives in a preferred embodiment a number of simultaneous measurement signals MS corresponding to one less than the number of speakers, i.e. in the example of FIGS. 3 and 4 it receives four measurement signals simultaneously. In an embodiment of the present invention, the speaker measurement amplifier SMA thus comprises one input channel less than the number of utility audio channels in the system, i.e. for example four input channels instead of five, and the speaker measurement amplifier further comprises logics for coupling the relevant speakers to the input channels and managing which measurements correspond to which, speakers. In a preferred embodiment, however, the speaker measurement amplifier comprises an input for each speaker channel, and for each measurement, one of the channels is idle. The speaker measurement amplifier SMA comprises a suitable amplifier for each input channel. These amplifiers should preferably be capable of amplifying a weak and noise-filled signal into a signal suitable for performing the response analysis, and may, e.g., comprise conventional microphone pre-amplifiers. Because passive loudspeakers are used as microphones, typically connected to the power amplifier with conventional speaker cables, the measurement signals are very noise sensitive, e.g. to noise induced by the active speaker, i.e. the speaker playing the test signals, and to hum and buzz from electrical equipment and the mains. Also, due to noise issues, the speaker cables should preferably be twisted pair cables, but any speaker cable types or other cable types are within the scope of the present invention.

In a preferred embodiment, the speaker measurement amplifier further comprises filtering means for, e.g., increasing the signal-to-noise ratio and other factors to improve the measurement signal quality by filtering or time-windowing of the speaker-room-speaker impulse response $y_{srs}(t)$.

In a preferred embodiment, the speaker measurement amplifier further comprises analog-to-digital converters for establishing a digital amplified measurement signal AMS for transmitting the measurement data to the room correction controller RCC. In an alternative embodiment the amplified measurement signal AMS sent to the room correction controller is an analog signal.

The room correction controller RCC preferably comprises means for controlling the input/output switches IOS and the test signal switch TSS as described above. In a preferred embodiment, it further comprises means for establishing a suitable test signal, e.g. a sine sweep. The room correction controller further comprises means for initiating and managing the measurement procedure. In a preferred embodiment, the room correcting amplifier RCA comprises a button, a remote control command, or other user input means, for initiating an automatic room correction routine. The user may, e.g., run an automatic room correction when some parts of the audio system are renewed, e.g. a new set of speakers, when new parts are introduced, e.g. additional surround speakers, when audio system parts or furniture is moved, e.g. rearrangement of the home cinema, etc. In alternative embodiments, the automatic room correction is performed every time the room correcting amplifier is switched on, or at predefined intervals, e.g. once a week. In embodiments where the automatic room correction is performed at regular intervals with the same setup, the results may be used for diagnosing, e.g. to determine if a speaker is becoming bad, etc.

The room correction controller RCC further comprises means for analysing the amplified measurement signal AMS, either a digital data signal or analog signals. The analysis comprises in room correction context determining the speaker-room-speaker responses, solving the equation system, thereby determining the average coloration log-magnitude responses A, B, . . . , for each speaker channel, and on the basis thereof, establishing an equalization target response for each speaker channel. In an embodiment of the present invention, the established equalization target responses are provided to the user as a recommendation for setting the equalizer. In a preferred embodiment of the present invention, the room correcting amplifier RCA comprises an equalizer EQ that is controlled by the room correction controller RCC by means of equalization data EQD comprising the established equalization target response for each channel. The equalizer may be located in the signal chain prior to or subsequent to the location of injecting the test signal TS. When located subsequent to the test signal injection, as in the example of FIG. 4, the equalizer should be reset to a flat, or alternatively a desired, predetermined measurement setting, before the measurements are initiated. In a further, more advanced embodiment, the equalization settings may be adaptively modified during the measurement procedure in order to fine tune the settings. According to such an embodiment, a first analysis may be performed with a flat equalization setting. The resulting equalization target responses may be loaded into the equalizer, and a new analysis may be performed using these settings. By taking the equalization settings into account during the second analysis, it may be possible to further improve the equalization target responses. In an embodiment of the present invention, the room correcting amplifier RCA does not comprise an equalizer itself, but has access to controlling the equalizer in the pre-amplifier PRA, and may thus apply the room correction settings there.

In applications where the measurement controller RCC is merely used for measuring and analysing, but not applying changes to the system, no equalizer EQ and control thereof is required. Instead, an output means for enabling the measurement controller to provide information to the user may be required.

In an alternative embodiment of the present invention, the power amplifier PWA is a common power amplifier, and the room correction controller RCC, the input/output switches IOS, the speaker measurement amplifier SMA, the equalizer EQ and the test signal switch TSS are implemented in a separate box, a room correcting module RCM, and connected to the inputs and outputs of the power amplifier as illustrated in FIG. 5. Again, the example may as well be used for other measuring and processing purposes than only room correction. As illustrated, the measurement or room correcting module RCM provides a room corrected pre-amplified multi-channel signal RPMS to the external power amplifier PWA, and the multi-channel speaker signal MSS established by the power amplifier is delivered back to the room correcting module RCM in order to enable the function of switching off the power signals to some of the speakers when relevant.

The embodiment of FIG. 5 thus enables automatic room correction or other information or control applications, while still using all components of an existing sound system, provided the speakers are passive in the sense of the present invention, and provided access to the input of the pre amplifier or power amplifier and the output of the power amplifier is available.

When automatic room correction measurements are not performed, the pre-amplified multi-channel signals PAMS are still processed by the equalizer EQ before amplified by the power amplifier PWA, and hence the room correcting equalization target responses are still applied.

FIG. 6 illustrates a further, alternative embodiment of a measurement or room correcting amplifier RCA according to the present invention. Again, the example may as well be used for other measuring and processing purposes than only room correction. It comprises a measurement or room correction controller RCC which controls a test signal TS and a test signal switch TSS, and which receives an amplified measurement signal AMS comprising measurements results, and establishes equalization data EQD comprising equalizer target responses, as described above regarding FIGS. 4 and 5. It further comprises an equalizer EQ for applying the established room correction parameters to incoming pre-amplified multi-channel signals PAMS, and it outputs a multi-channel speaker signal MSS to a set of speakers SA, SB, SC, SD, SE, as described above regarding FIGS. 4 and 5. For power amplification of the room corrected pre-amplified signals and for amplification of the measurement signals, it, however, comprises a combined power and measurement amplifier PMA.

The combined power and measurement amplifier PMA comprises inputs for pre-amplified signals, means for amplifying them, and speaker outputs as a conventional power amplifier. In addition to that, it comprises means for measuring small signal variations on the speaker outputs, i.e. for use when the speakers act as microphones, and amplifying and possibly filtering those signal variations into amplified measurement signals AMS, either digital or analog. If the power amplifier part of the combined power and measurement amplifier PMA comprises a feedback loop, the measurement amplifier may, e.g., use that as pickup point for the measurement signals.

The room correcting amplifier of FIG. 6 may in alternative embodiments comprise switches or relays, like the input/output switches of FIGS. 4 and 5, for muting the audio channels which speakers are currently used as microphones. Such switches may be arranged prior to the equalizer EQ, between the equalizer EQ and the power and measurement amplifier PMA, or within the power and measurement amplifier PMA, e.g. by providing means for shutting the power amplifier part of one or more channels down without interrupting the corresponding feedback loops from which the measurement signals may be picked up.

For all the above described embodiments, it applies that any persons in the room do not have to be particularly silent for the automatic room correction or other measurements and information establishment to be performed. Neither is background noise, such as, e.g. heavy road traffic, a nearby airport, kitchen noise, air conditioner noise, etc., a problem. Such background noise may only prolong the time necessary to finish the automatic room correction, as then more measurements are necessary in order to determine a reliable average. In a preferred embodiment, the measurements are performed several times and averaged in order to filter out noise, and then coloration log-magnitude responses are established for each speaker on the basis of the averaged measurements. In an alternative embodiment, the above mentioned measurements and calculations are performed several times, and then the several established coloration log-magnitude responses for each speaker are averaged. As the calculations leading to the coloration responses are typically heavier than averaging calculations, the first mentioned arrangement is often the most cost-effective. Depending on the deviation between different measurements, the number of measurements to include in order to establish a reliable result may be determined, according to standard statistics theory. In a preferred embodiment, the measurement time for a 5-channel audio system is 1-2 minutes, depending on the degree of disturbance from background noise.

The frequency band to include in the measurements regarding room correction is preferably the full audio band, i.e. 20 Hz-20 kHz, or even, e.g., 8 Hz-50 kHz. As described above, the present invention however provides the best room correction results for relatively low frequencies. Moreover, in a practical setup the results also depend on the capability of the speakers, both because they are used for the measurements and thus are incapable of measuring reliably outside their range, and because even though such measurements were performed, e.g. by means of additional microphones, it would have no effect, as the speakers would still not be capable of rendering audio reliably outside their range. Hence, in a preferred embodiment the measurements and calculations should be performed for a frequency range from, e.g. 10 or 15 Hz, to, e.g., 500 or 1000 Hz. The lower limit may, e.g., be determined from the first measurement of each speaker as the frequency where a reliable or realistic signal is received from the speaker.

In stereo systems, i.e. where N=2, only an average coloration log-magnitude response for both speakers is established, instead of distinct responses for each speaker, as described above, due to the, in that case, singular equation system. Hence, the upper frequency limit for obtaining advantageous improvements by the present invention may be lower, e.g. 150 Hz.

In a preferred embodiment, the established equalization target responses are subject to limiting or other kinds of filtering before applied to the equalizer. Such limiting may, e.g., comprise a maximum of 12 dB amplification, in order to protect the subsequent audio components, e.g. the power amplifier input stage and the speakers, and in order to avoid clipping. This limiting may be necessary in rooms and setups that handle certain frequencies or frequency bands very poorly, and for which an unrealistically high gain is thus required.

FIG. 7*a* to FIG. 7*c* and FIGS. 8*a* and 8*b* illustrates schematically for one embodiment of the invention a simulated example of using the cross correlation technique described above to make a spatial mapping of the relative positions of loudspeakers in an audio system.

FIG. 7*a* illustrates a white noise test signal applied to a loudspeaker (e.g. SA) in an audio system acting as a speaker. The test signal is applied for approx. 500 ms from time t=0.

FIG. 7*b* illustrates another, different, white noise test signal applied to another loudspeaker (e.g. SB) in an audio system acting as a speaker. This test signal is also applied for approx. 500 ms, from time t=0. The test signals applied to loudspeaker SA and SB respectively must be different signals.

FIG. 7*c* illustrates a speaker output for yet another loudspeaker (e.g. SC) in an audio system acting as a microphone. The signal is a mixture of the two transmitted test signals applied to speakers SA and SB that have been acoustically summed while propagating through the room, plus background noise.

FIGS. 8*a* and 8*b* illustrates the resultant functions after calculating cross correlations between input signal SA and output signal SC (FIG. 8*a*) and input signal SB and output signal SC (FIG. 8*b*). As can be seen on the graphs prominent peaks occur at time t=19.85 ms (FIG. 8*a*) and time t=18.80 ms (FIG. 8*b*) indicating the distance between speakers SA-SC and SB-SC respectively. By applying the relation $D=c\cdot\Delta t$, where c is the speed of sound through air, to the measured values, the distance D from loudspeaker SA and SB to loudspeaker SC respectively can be calculated and for the present example the distance SA to SC=300 m/s·19.85 ms=5.96 m, whereas the distance SB to SC=300 m/s·18.80 ms=5.64 m.

For the above mentioned example, which is for illustrative purposes only, delays occurring from post processing of the signals such as input buffer delay, converter delay or like have not been taken into account. In a real world measurement however, distance calculations can be corrected for the said delays in order to obtain a more accurate measurement. Furthermore the speed of sound c is approximated to be 300 m/s, but other, more correct values may evidently be used.

For one embodiment of the invention the determination of distance between loudspeakers and/or a spatial mapping of the relative positions of loudspeakers can be used in an audio system such as large loudspeaker arrays where it is important to know the exact physical position and/or the relative position and/or the distance between and/or the order of each loudspeaker in said loudspeaker array. By applying technique such as said cross correlation technique to the loudspeakers comprised in the array, said measurements can be achieved by relatively simple calculations that do not require excessive computational power.

By applying said technique such as said cross correlation technique to an audio system, it is in alternative embodiments of the present invention, possible to deduce unknown information from the measured signals, post processed or not post processed, about qualitative and quantitative parameters such as optimal listening position, room response, the involved audio equipment or like.

FIG. 9 illustrates schematically a practical test setup according to the above mentioned simulation example i.e. a test setup that would yield a similar practical test result as the simulation. Speakers SA and SB act as loudspeakers and speaker SC acts as microphone. Two different white noise test signals TSA and TSB, possibly similar to FIGS. 7*a* and 7*b* are applied to the input terminals of speakers SA and SB respectively. TSA and TSB are transmitted/propagated to speaker SC where they produce a test output signal TOS, possibly similar to FIG. 7*c*. This test output signal is data processed i.e.

cross correlation calculations are performed, e.g. by a measurement controller RCC, producing one cross correlation function for each speaker input—CCFA and CCFB, possibly similar to FIGS. 8*a* and 8*b* respectively. From the cross correlation functions CCFA and CCFB the distances AC and BC can be calculated. Delays occurring in transmission lines, from post processing of the signals such as input buffer delay, converter delay or like are supposed to be of well known values and therefore can be correctly incorporated in the calculation of CCFA and CCFB, or they can be considered insignificant.

In other embodiments of the present invention all speakers of the audio system can act as either speakers or microphones and the speaker or speakers that acts as a microphone and the speaker or speakers that acts as a loudspeaker can be chosen randomly or by a predefined control/measurement strategy.

FIG. 10 illustrates schematically for another embodiment of the invention, the principle of another circuitry that enables a speaker to act both as a loudspeaker and a microphone. Hence, the FIG. 10 illustrates an embodiment of a combined power and measurement amplifier PMA, e.g. for use in the embodiment described above with reference to FIG. 6. FIG. 10 illustrates an amplifier with feedback, a loop filter, and an amplifier. It is noted that the amplifier may be any kind of amplifier, i.e. an analogue amplifier, a PWM switching amplifier, etc. When the speaker is supposed to act as a loudspeaker, the input switch SWI is positioned as to establish contact between audio input AI and the positive input to summation point and the audio signal occurring at the audio input is first amplified and applied to the input terminals of the loudspeaker, and errors are suppressed by the feedback. When the speaker acts as a microphone, the positive input of the summation point is put to ground and the output signal from the speaker (microphone) is via the feedback loop fed to the negative input of the summation point. Hereafter it appears at the microphone output MO in an inverted representation for further amplification and/or processing in the audio system. This embodiment works partly because the signal at the amplified side of the speaker does not disturb the signal at the input side of the amplifier, which would cause the signal to be neutralized. In an advanced embodiment, the switch SWI is omitted, and the microphone output processing means subtracts the input signal from the measured microphone output, thereby facilitating using the loudspeaker for measuring simultaneously with producing sound.

FIG. 11 illustrates schematically for another embodiment of the invention, the principle of a circuitry that enables a speaker to act both as a loudspeaker and a microphone, e.g. for use as combined power and measurement amplifier PMA. The circuit is designed as a class D amplifier which is an amplifier that is operated in on/off mode.

When the circuit enables the speaker to act as a loudspeaker, an audio input signal is applied to said circuit. The speaker terminals are now input terminals. A digital pulse width modulator Dpwm is converting the audio input signal to a pulse width modulated digital signal that controls digital switches DS1 and DS2. At high levels of the modulated digital signal switch DS1 is closed and DS2 is open which enables +Vcc to be coupled to the input terminal of the loudspeaker. At low levels of the modulated digital signal, switch DS1 is open and DS2 is closed which in turn enables −Vcc to be coupled to the input terminal of the loudspeaker. Furthermore the switch DS3 is open disconnecting an input signal processing circuit. The response characteristic of the loudspeaker provides a low-pass filtering of the digital signal at its input terminal. In other embodiments of the invention additional active or passive filter components and/or circuits can be added to filter the digitized signal at the loudspeaker input terminal.

When the circuit enables the speaker to act as a microphone the speaker terminals are output terminals and both digital switches DS1 and DS2 are open. Hereby the digital pulse width modulator Dpwm is disconnected from the speaker circuit. Generated signals at the output terminal of the speaker (microphone) are fed to an A/D circuit for further signal processing.

Digital switches DS1, DS2 and DS3 are electronically operated switching elements such as MOSFETs, valves or bipolar transistors. The switch DS3 may either be controlled by the measurement controller, or it may, e.g., be controlled by the same signals that control switches DS1 and DS2 by additional logics, e.g. so that switch DS3 is closed only when both DS1 and DS2 are open, and not in any other conditions.

By the mentioned circuit embodiment and similar embodiments a relatively simple implementation of a circuit that complies with embodiments of the present invention is achieved.

The invention claimed is:

1. Method of performing measurements by means of an audio system comprising passive loudspeakers, whereby said measurements are performed by using at least one of said loudspeakers for producing sound and at least one of said loudspeakers for measuring said sound, further including the step of analysing said measurements to determine a set of loudspeaker coloration responses, whereby an equalization target response for a loudspeaker is established on the basis of said loudspeaker coloration responses.

2. Method of performing measurements according to claim 1, whereby said measurements comprises impulse responses.

3. Method of performing measurements according to claim 1, whereby said measurements comprises speaker-room-speaker responses.

4. Method of performing measurements according to claim 3, whereby said speaker-room-speaker responses are log-magnitude responses.

5. Method of performing measurements according to claim 3, whereby said speaker-room-speaker responses are log-frequency responses or pairs of log-magnitude responses and group-delay responses.

6. Method of performing measurements according to claim 3, whereby said speaker-room-speaker responses are impulse responses.

7. Method of performing measurements according to claim 3, whereby said speaker-room-speaker responses are measured for a frequency range of substantially 5 Hz to substantially 500 Hz.

8. Method of performing measurements according to claim 1, whereby said audio system comprises N passive loudspeakers, and said measurements are performed between pairs of said loudspeakers, N being at least two.

9. Method of performing measurements according to claim 8, whereby N is at least 3, and said measurements comprise measuring N·(N−1) speaker-room-speaker responses, where each of said N loudspeakers are used for producing sound in N−1 measurements, and each of said N loudspeakers are used for measuring said sound in N−1 measurements.

10. Method of performing measurements according to claim 8, whereby a loudspeaker coloration response is determined for each of said N loudspeakers by solving an equation system comprising N·(N−1) speaker-room-speaker responses.

11. Method of performing measurements according to claim 1, whereby said method comprises analysing said measurements for determining spatial information.

12. Method of performing measurements according to claim 11, whereby said spatial information comprises information about the relative location of said passive loudspeakers.

13. Method of performing measurements according to claim 11, whereby said spatial information comprises an acoustical image of the surroundings of said audio system.

14. Method of performing measurements according to claim 13, whereby room modes of said surroundings are determined from said measurements.

15. Method of performing measurements according to claim 14, whereby an equalization target response is established on the basis of said room modes.

16. Method of performing measurements according to claim 11, whereby said spatial information comprises an estimated optimal listening position.

17. Method of performing measurements according to claim 11, whereby said spatial information is determined by calculating cross correlation functions between said produced sound and said measured sound.

18. Method of performing measurements according to claim 1, whereby said method comprises analysing said measurements for determining room response information.

19. Method of performing measurements according to claim 1, whereby said loudspeaker coloration responses comprise representations of the frequency response of said loudspeakers and how said loudspeakers acoustically couple to their surroundings.

20. Method of performing measurements according to claim 1, whereby said loudspeaker coloration responses comprise least-squares average coloration log-magnitude responses of said loudspeakers.

21. Method of performing measurements according to claim 1, whereby distances between loudspeakers are determined on the basis of an analysis of cross correlation functions for absolute maxima and multiplying with the speed for sound through air.

22. Method of performing measurements according to claim 1, whereby said loudspeaker coloration responses are determined by analysing an equation system based on said measurements.

23. Method of performing measurements according to claim 22, whereby said equation system is linear.

24. Method of performing measurements according to claim 1, whereby said loudspeaker coloration responses are determined by solving an equation system comprising speaker-room-speaker responses.

25. Method of performing measurements according to claim 1, whereby said equalization target response is established by subtracting a loudspeaker coloration response from a system target response.

26. Method of performing measurements according to claim 1, whereby said equalization target response is filtered.

27. Method of performing measurements according to claim 1, whereby said equalization target response is implemented in an audio system comprising N passive loudspeakers for enabling room corrected operation of said audio system in said surroundings.

28. Method of performing measurements according to claim 1, whereby said equalization target response is implemented in an audio system comprising N passive loudspeakers for improving the tonal balance of said audio system in said surroundings.

29. Method of performing measurements according to claim 1, whereby said measurements and/or determining information is repeated several times and averaged information is determined.

30. Method of performing measurements according to claim 1, whereby said measurements are performed several times, average measurement results calculated, and said determining information is based thereon, thereby determining averaged information.

31. Method of performing measurements according to claim 1, whereby said sound comprises music.

32. Method of performing measurements according to claim 1, whereby said sound comprises maximum length sequence MLS signals.

33. Method of performing measurements according to claim 1, whereby one loudspeaker produces sound and at least two loudspeakers measure said sound simultaneously.

34. Method of performing measurements according to claim 1, whereby at least two loudspeakers produce different sound and at least one loudspeaker measures said sound.

35. Method of performing measurements according to claim 1, whereby said loudspeakers produce and measure sound simultaneously.

36. Method of performing measurements according to claim 1, whereby an equalization target response for a loudspeaker is established on the basis of said loudspeaker coloration responses.

37. Method of performing measurements by means of an audio system comprising passive loudspeakers, whereby said measurements are performed by using at least one of said loudspeakers for producing sound and at least one of said loudspeakers for measuring said sound, whereby said method comprises analysing said measurements for determining spatial information, whereby said spatial information comprises an acoustical image of the surroundings of said audio system, whereby room modes of said surroundings are determined from said measurements, whereby an equalization target response is established on the basis of both a loudspeaker coloration response and said room modes.

38. Method of performing measurements according to claim 37, whereby said method comprises analysing said measurements to determine a set of loudspeaker coloration responses, whereby an equalization target response for a loudspeaker is established on the basis of said loudspeaker coloration responses.

39. Method of performing measurements according to claim 38, whereby an equalization target response for a loudspeaker is established on the basis of said loudspeaker coloration responses.

40. Method of performing measurements according to claim 38, whereby said loudspeaker coloration responses comprise representations of the frequency response of said loudspeakers and how said loudspeakers acoustically couple to their surroundings.

41. Method of performing measurements according to claim 38, whereby said loudspeaker coloration responses comprise least-squares average coloration log-magnitude responses of said loudspeakers.

42. Method of performing measurements according to claim 38, whereby said loudspeaker coloration responses are determined by analysing an equation system based on said measurements.

43. Method of performing measurements according to claim 42, whereby said equation system is linear.

44. Method of performing measurements according to claim 38, whereby said loudspeaker coloration responses are determined by solving an equation system comprising speaker-room-speaker responses.

45. Method of performing measurements according to claim 37, whereby said measurements comprise impulse responses.

46. Method of performing measurements according to claim 37, whereby said measurements comprise speaker-room-speaker responses.

47. Method of performing measurements according to claim 46, whereby said speaker-room-speaker responses are log-magnitude responses.

48. Method of performing measurements according to claim 46, whereby said speaker-room-speaker responses are log-frequency responses or pairs of log-magnitude responses and group-delay responses.

49. Method of performing measurements according to claim 46, whereby said speaker-room-speaker responses are impulse responses.

50. Method of performing measurements according to claim 46, whereby said speaker-room-speaker responses are measured for a frequency range of substantially 5 Hz to substantially 500 Hz.

51. Method of performing measurements according to claim 37, whereby said audio system comprises N passive loudspeakers, and said measurements are performed between pairs of said loudspeakers, N being at least two.

52. Method of performing measurements according to claim 51, whereby N is at least 3, and said measurements comprise measuring N·(N−1) speaker-room-speaker responses, where each of said N loudspeakers are used for producing sound in N−1 measurements, and each of said N loudspeakers are used for measuring said sound in N−1 measurements.

53. Method of performing measurements according to claim 51, whereby a loudspeaker coloration response is determined for each of said N loudspeakers by solving an equation system comprising N·(N−1) speaker-room-speaker responses.

54. Method of performing measurements according to claim 37, whereby said spatial information comprises information about the relative location of said passive loudspeakers.

55. Method of performing measurements according to claim 37, whereby said spatial information comprises an estimated optimal listening position.

56. Method of performing measurements according to claim 37, whereby said method comprises analysing said measurements for determining room response information.

57. Method of performing measurements according to claim 37, whereby said spatial information is determined by calculating cross correlation functions between said produced sound and said measured sound.

58. Method of performing measurements according to claim 37, whereby distances between loudspeakers are determined on the basis of an analysis of cross correlation functions for absolute maxima and multiplying with the speed for sound through air.

59. Method of performing measurements according to claim 37, whereby said equalization target response is established by subtracting a loudspeaker coloration response from a system target response.

60. Method of performing measurements according to claim 37, whereby said equalization target response is filtered.

61. Method of performing measurements according to claim 37, whereby an equalization target response is established on the basis of said room modes.

62. Method of performing measurements according to claim 37, whereby said measurements and/or determining information is repeated several times and averaged information is determined.

63. Method of performing measurements according to claim 37, whereby said measurements are performed several times, average measurement results calculated, and said determining information is based thereon, thereby determining averaged information.

64. Method of performing measurements according to claim 37, whereby said sound comprises music.

65. Method of performing measurements according to claim 37, whereby said sound comprises maximum length sequence MLS signals.

66. Method of performing measurements according to claim 37, whereby one loudspeaker produces sound and at least two loudspeakers measure said sound simultaneously.

67. Method of performing measurements according to claim 37, whereby at least two loudspeakers produce different sound and at least one loudspeaker measures said sound.

68. Method of performing measurements according to claim 37, whereby said loudspeakers produce and measure sound simultaneously.

69. Method of performing measurements by means of an audio system comprising passive loudspeakers, whereby said measurements are performed by using at least one of said loudspeakers for producing sound and at least one of said loudspeakers for measuring said sound, whereby a set of equalization target responses for improving the tonal balance of an audio system in a room, said audio system comprising at least N passive loudspeakers, N being at least two, is established by performing the steps of:

determining, for P combinations of loudspeaker pairs in said audio system, the speaker-room-speaker response for a test signal provided to a loudspeaker of said loudspeaker pair and captured by the other loudspeaker of said loudspeaker pair, said other loudspeaker operating as a microphone, P being equal to or larger than N, establishing N equalization target responses on the basis of said P speaker-room-speaker responses, said N equalization target responses corresponding to said N loudspeaker channels of said audio system.

70. Method of determining a set of loudspeaker coloration responses for at least one out of N passive loudspeakers, whereby said loudspeaker coloration responses are determined by analysing measurements performed by using at least one of said loudspeakers for producing test sound and at least one of said loudspeakers for measuring said test sound, whereby an equalization target response for a loudspeaker is established on the basis of said loudspeaker coloration responses.

71. Method of determining a set of loudspeaker coloration responses according to claim 70, whereby said loudspeaker coloration responses comprise representations of the frequency response of said loudspeakers and how said loudspeakers acoustically couple to their surroundings.

72. Audio system comprising N passive loudspeakers, wherein said audio system further comprises an output stage where each output acts as a combined output channel and a measurement input, wherein said audio system comprises means for performing measurements by using at least one of said loudspeakers as a microphone, wherein said measurements comprise impulse responses, and wherein said measurements comprise speaker-room-speaker responses.

73. Audio system according to claim 72, wherein said output stage comprises a measurement controller, and wherein said measurement controller comprises means for determining spatial information on the basis of said measurements.

74. Audio system according to claim 73, wherein said spatial information comprises information about the relative location of said passive loudspeakers.

75. Audio system according to claim 73, wherein said spatial information comprises an estimated optimal listening position.

76. Audio system according to claim 72, wherein said output stage comprises a measurement controller, and wherein said measurement controller comprises means for determining room response information on the basis of said measurements.

77. Audio system according to claim 76, wherein said room response information comprises loudspeaker coloration responses.

78. Audio system according to claim 77, wherein said output stage comprises means for establishing equalization target responses on the basis of said loudspeaker coloration responses.

79. Audio system according to claim 72, wherein said output stage comprises a measurement controller, wherein said measurement controller comprises a room correction controller and wherein said room correction controller comprises means for establishing equalization target responses on the basis of said loudspeaker coloration responses.

80. Audio system according to claim 72, wherein said audio system comprises a room correctable audio system.

81. Audio system according to claim 72, wherein said output stage comprises a room correcting output stage.

82. Audio system according to claim 72, wherein said output stage comprises an equalizer and wherein said measurement controller cooperates with said equalizer in implementing said equalization target responses in said audio system.

83. Audio system according to claim 72, wherein said output stage comprises a power amplifier and wherein said power amplifier (PWA) comprises means for measuring signals from loudspeakers used as microphones.

84. Audio system according to claim 72, wherein said output stage comprises a measurement controller, and wherein said measurement controller comprises means for performing cross correlation between output signals and input signals of said audio system.

85. Audio system according to claim 72, wherein said output stage comprises means for determining loudspeaker coloration responses on the basis of speaker-room-speaker responses measured between pairs of said loudspeakers.

86. Audio system according to claim 72, wherein said output stage comprises a measurement controller, and wherein said measurement controller is implemented in a measurement module as an add-on to a common audio amplifier system.

87. Audio system according to claim 72, wherein said output stage comprises a measurement controller comprising a room correcting controller which is implemented in a room correcting module as an add-on to a common audio amplifier system.

88. Method of determining a set of loudspeaker coloration responses for at least one out of N passive loudspeakers, whereby said loudspeaker coloration responses are determined by analysing measurements performed by using at least one of said loudspeakers for producing test sound and at least one of said loudspeakers for measuring said test sound, whereby said loudspeaker coloration responses are determined by analysing an equation system based on said measurements.

89. A room correcting module comprising:

a multi-channel speaker input for connecting to an output of a power amplifier;

a multi-channel speaker input/output for connecting to an input of a passive loudspeaker, the multi-channel speaker input/output being controllably connected to the multi-channel speaker input via a set of input/output switches;

a speaker measurement amplifier being controllably connected to the multi-channel speaker input/output via the set of input/output switches; and a room correction controller connected to the speaker measurement amplifier to receive an amplified measurement signal and being connected to a control input of the set of input/output switches;

wherein said room correction controller is arranged to determine spatial information about a relative location of a passive loudspeaker on the basis of the amplified measurement signal.

90. The room correcting module of claim 89, wherein the room correcting module further comprises:

a multi-channel signal input for receiving a multi-channel audio signal from an upstream audio device; and a multi-channel signal output for connecting to an input of a power amplifier, wherein a multi-channel audio signal is shaped by a process controlled by the room correction controller and then output via the multi-channel signal output.

* * * * *